US005257470A

United States Patent [19]

Auger et al.

[11] Patent Number: 5,257,470

[45] Date of Patent: Nov. 2, 1993

[54] SHOE BLADDER SYSTEM

[75] Inventors: Perry W. Auger; Daniel R. Potter, both of Tigard; Bruce J. Kilgore, Lake Oswego, all of Oreg.

[73] Assignee: Nike, Inc., Beaverton, Oreg.

[21] Appl. No.: 656,728

[22] Filed: Feb. 19, 1991

Related U.S. Application Data

[63] Continuation-in-part of Ser. No. 558,335, Jul. 27, 1990, abandoned, Ser. No. 521,011, May 9, 1990, abandoned, Ser. No. 416,262, Oct. 3, 1989, abandoned, and Ser. No. 480,586, Feb. 15, 1990, abandoned, said Ser. No. 558,335, is a continuation-in-part of Ser. No. 521,011, Feb. 15, 1990, which is a continuation-in-part of Ser. No. 324,705, Mar. 17, 1989, abandoned, Ser. No. 416,262, Mar. 17, 1989, and Ser. No. 480,586, Mar. 17, 1989, which is a continuation-in-part of Ser. No. 324,705, Mar. 17, 1989, and Ser. No. 416,262, Mar. 17, 1989.

[51] Int. Cl.[5] ..... A43B 7/06; A43B 7/14

[52] U.S. Cl. ..... 36/88; 36/114; 36/29; 36/71

[58] Field of Search ..... 36/115, 91, 29, 28, 36/119, 120, 93, 88, 71, 92, 114, 36; 128/80 H; 417/472, 478, 413, 520, 306, 307; 24/589; 138/119, 121; 137/596.2, 625.47; 285/305

[56] References Cited

U.S. PATENT DOCUMENTS

| | | | |
|---|---|---|---|
| 435,452 | 9/1890 | Richards . | |
| 518,579 | 4/1894 | Annenberg . | |
| 562,984 | 6/1896 | Store | 285/305 X |
| 643,181 | 2/1900 | Woodworth | 285/305 X |
| 746,338 | 12/1903 | Keen . | |
| 1,313,924 | 8/1919 | Stewart . | |
| 1,364,226 | 1/1921 | Wherry . | |
| 1,375,585 | 4/1921 | Goodwin . | |
| 1,605,985 | 11/1926 | Rasmussen . | |
| 1,730,466 | 10/1929 | Mallott . | |
| 1,757,019 | 5/1930 | Mott . | |
| 1,807,085 | 5/1931 | Crickmer | 137/625.47 |
| 1,954,122 | 4/1934 | Fiori . | |
| 2,020,240 | 11/1935 | Cochran . | |
| 2,028,060 | 1/1936 | Gilbert . | |
| 2,086,389 | 7/1937 | Pearson . | |
| 2,103,108 | 12/1937 | Broecker et al. . | |
| 2,141,033 | 12/1938 | Crowley . | |
| 2,150,290 | 3/1939 | Mulvey . | |
| 2,177,116 | 10/1939 | Persichino . | |
| 2,247,961 | 7/1941 | Mulvey . | |
| 2,255,932 | 9/1941 | Kraft et al. . | |
| 2,276,502 | 3/1942 | McCoy . | |
| 2,365,807 | 12/1944 | Dialynas . | |
| 2,439,545 | 4/1948 | Matlas . | |
| 2,531,763 | 11/1950 | Andre . | |

(List continued on next page.)

FOREIGN PATENT DOCUMENTS 515639 12/1952 Belgium .

(List continued on next page.)

OTHER PUBLICATIONS

"Pumping Up", *Footwear News*, Apr. 3, 1989, p. 1.

(List continued on next page.)

*Primary Examiner*—Steven N. Meyers
*Assistant Examiner*—Ted Kavanaugh
*Attorney, Agent, or Firm*—Banner, Birch, McKie & Beckett

[57] ABSTRACT

For athletic shoes, a custom fit bladder system including first and second separately pressure adjustable chambers for different foot portions. First and second bladder stems communicate with the first and second chambers, respectively. A tension wire bail secures the stems to a tee manifold between them. A bulb pump held on the shoe includes an articulated connector at one end and a flush mounted inlet valve retained at the other end. External barbs on the manifold lock into holes in the connector providing a secure air-tight attachment of the bulb pump to the manifold. A button dial allows the user to select which of the chambers he can inflate by pumping the pump and deflate by pushing a deflation valve disposed in the manifold.

6 Claims, 28 Drawing Sheets

U.S. PATENT DOCUMENTS

| | | | |
|---|---|---|---|
| 2,605,560 | 8/1952 | Gouabault . | |
| 2,638,690 | 5/1953 | Bullard . | |
| 2,663,020 | 12/1953 | Cushman . | |
| 2,686,006 | 8/1954 | Hasselquist . | |
| 2,699,915 | 1/1955 | Goepfrich | 285/305 X |
| 2,715,231 | 8/1955 | Marston . | |
| 2,774,152 | 12/1956 | Alber . | |
| 2,830,585 | 4/1958 | Weiss . | |
| 2,898,741 | 8/1959 | Milliken | 285/305 X |
| 2,942,359 | 6/1960 | Bushway et al. . | |
| 3,027,659 | 4/1962 | Gianola . | |
| 3,030,640 | 4/1962 | Gosman . | |
| 3,078,864 | 2/1963 | Schmid et al. . | |
| 3,081,774 | 3/1963 | Lelyveld . | |
| 3,121,430 | 2/1964 | O'Reilly . | |
| 3,134,418 | 5/1964 | McConkie . | |
| 3,186,004 | 6/1965 | Carlini . | |
| 3,273,263 | 9/1966 | Klima . | |
| 3,312,213 | 4/1967 | Timm . | |
| 3,314,696 | 4/1967 | Ferguson et al. | 285/305 X |
| 3,316,663 | 5/1967 | Neu . | |
| 3,372,495 | 3/1968 | Finn . | |
| 3,410,004 | 11/1968 | Finn . | |
| 3,469,576 | 9/1969 | Smith et al. . | |
| 3,508,572 | 4/1970 | Paffrath . | |
| 3,523,701 | 8/1970 | Graham | 285/305 X |
| 3,527,485 | 9/1970 | Goward et al. | 285/305 |
| 3,537,716 | 11/1970 | Norgiel . | |
| 3,538,940 | 11/1970 | Graham | 285/305 X |
| 3,659,361 | 5/1972 | White, Sr. . | |
| 3,664,043 | 5/1972 | Polumbus, Jr. . | |
| 3,685,176 | 8/1972 | Rudy . | |
| 3,716,930 | 2/1973 | Brahm . | |
| 3,744,159 | 7/1973 | Nishimura . | |
| 3,750,310 | 8/1973 | Messner et al. . | |
| 3,753,582 | 8/1973 | Graham | 285/305 |
| 3,758,964 | 9/1973 | Nishimura . | |
| 3,760,056 | 9/1973 | Rudy . | |
| 3,780,736 | 12/1973 | Chen | 137/625.47 X |
| 3,854,228 | 12/1974 | Conroy . | |
| 3,872,511 | 3/1975 | Nichols . | |
| 3,876,746 | 4/1975 | Hanson . | |
| 3,925,916 | 12/1975 | Grabuio . | |
| 4,035,846 | 7/1977 | Jencks . | |
| 4,067,063 | 1/1978 | Ettinger . | |
| 4,068,323 | 1/1978 | Gwon . | |
| 4,126,323 | 11/1978 | Scherz . | |
| 4,178,013 | 12/1979 | Bataille . | |
| 4,183,155 | 1/1980 | Payne . | |
| 4,232,459 | 11/1980 | Vaccari . | |
| 4,236,725 | 12/1980 | Bataille . | |
| 4,266,298 | 5/1981 | Graziano . | |
| 4,287,613 | 9/1981 | Schulz . | |

(List continued on next page.)

FOREIGN PATENT DOCUMENTS

| | | |
|---|---|---|
| 951117 | 7/1974 | Canada . |
| 951118 | 7/1974 | Canada . |
| 40189 | 11/1981 | European Pat. Off. . |
| 152401 | 8/1985 | European Pat. Off. . |
| 155495 | 9/1985 | European Pat. Off. . |
| 221808 | 5/1987 | European Pat. Off. . |
| 2164921 | 10/1972 | Fed. Rep. of Germany . |
| 2215098 | 5/1973 | Fed. Rep. of Germany . |
| 2162619 | 6/1973 | Fed. Rep. of Germany . |
| 2308547 | 8/1974 | Fed. Rep. of Germany . |
| 2365329 | 9/1974 | Fed. Rep. of Germany . |
| 2456612 | 6/1975 | Fed. Rep. of Germany . |
| 3200139 | 5/1982 | Fed. Rep. of Germany . |
| 3326085 | 7/1983 | Fed. Rep. of Germany . |
| 3427664A | 1/1986 | Fed. Rep. of Germany . |
| 3600437 | 7/1987 | Fed. Rep. of Germany . |
| 1406610 | 11/1965 | France . |
| 2252820 | 6/1976 | France . |
| 2356384 | 1/1978 | France . |
| 2496423 | 6/1982 | France . |
| 87/03789 | 7/1987 | PCT Int'l Appl. . |
| 89/10074 | 11/1989 | PCT Int'l Appl. . |
| 90/04323 | 3/1990 | PCT Int'l Appl. . |
| 90/09115 | 8/1990 | PCT Int'l Appl. . |
| 11170 | of 1887 | United Kingdom . |
| 23547 | of 1889 | United Kingdom . |
| 26637 | of 1897 | United Kingdom . |
| 866934 | 5/1961 | United Kingdom . |
| 939529 | 10/1963 | United Kingdom . |
| 2111821A | 7/1983 | United Kingdom . |

OTHER PUBLICATIONS

"New Generation", *Footwear News,* Sep. 11, 1989, p. 26.

"Primed To Deliver The Pump", *Footwear News,* Oct. 2, 1989.

"NIKE Takes To The Scale To Win The Weight Test", *Footwear News,* Jan. 22, 1990.

(List continued on next page.)

U.S. PATENT DOCUMENTS 4,358,902 11/1982 Cole et al. .
4,361,969 12/1982 Vermonet .
4,370,754 2/1983 Donzis .
4,385,456 5/1983 Livernois et al. .
4,423,735 1/1984 Comparetto .
4,446,634 5/1984 Johnson et al. .
4,458,429 7/1984 Schmid .
4,481,970 11/1984 Reid .
4,538,367 9/1985 Adams .
4,539,764 9/1985 Prodier .
4,590,691 5/1986 Oliviero .
4,593,690 6/1986 Sheridan et al. .
4,593,717 6/1986 Levasseur ..... 137/625.47 X
4,631,843 12/1986 Annovi .
4,662,087 5/1987 Beuch .
4,670,995 6/1987 Huang .
4,688,829 8/1987 Shioda et al. ..... 285/305 X
4,702,022 10/1987 Porcher .
4,712,316 12/1987 Baggio .
4,719,670 1/1988 Kurt .
4,724,627 2/1988 Sisco .
4,730,403 3/1988 Walkhoff .
4,730,610 3/1988 Graebe .
4,739,813 4/1988 Pagani .
4,744,157 5/1988 Dubner .
4,756,306 7/1988 Durlee .
4,763,426 8/1988 Polus et al. .
4,776,110 10/1988 Shiang .
4,781,189 11/1988 Vijil-Rosales .
4,819,685 4/1989 Pagani .
4,832,482 4/1989 Lakic .
4,836,235 6/1989 Pagani .
4,852,564 8/1989 Sheridan et al. .
4,912,861 4/1990 Huang .
4,916,836 4/1990 Baggio et al. .
4,921,147 5/1990 Piorier .
4,927,191 5/1990 Mikol .
4,936,029 6/1990 Rudy .
4,949,479 8/1990 Ottieri .
4,955,149 9/1990 Ottieri .
4,962,762 10/1990 Beekil .
4,995,173 2/1991 Spier .
4,999,932 3/1991 Grim .
5,000,614 3/1991 Walker et al. ..... 285/305 X
5,015,515 5/1991 Paulin .
5,113,599 5/1992 Cohen et al. ..... 36/29 X

OTHER PUBLICATIONS

"Reebok Readies High-Tech Double Pump", *Footwear News,* Nov. 4, 1991, p. 26.
"Reebok Get Suspension Placed On Spalding Gloves", *Footwear News,* Jul. 22, 1991, p. 68.
"Reebok Activity Seeking To License Technology", *Footwear News,* Jul. 22, 1991, p. 66.
L. A. Gear Regulator Ad, *Footwear News,* Sep. 24, 1990.
L. A. Gear Regulator Ad, *Footwear News,* Oct. 1, 1990.
"Has Sneaker Madness Gone Too Far?", *Newsweek,* Dec. 18, 1989.
"Now, Running On Empty", *Newsweek,* Dec. 3, 1990.
Robinson et al., "Systematic Ankle Stabilization and the Effect on Performance", *Medicine and Science In Sports and Exercise,* vol. 18, No. 6, pp. 625-628, 1986.
"It's Back To The Future", *Sportstyle,* Mar. 6, 1989.
"Air Pressure From Nike" Ad, *USA Today,* Oct. 24, 1989.
"Pumped-Up Reebok Runs Fast Break With New Shoe", *Wall Street Journal,* Dec. 20, 1989.

SHOE BLADDER SYSTEM

CROSS-REFERENCE TO RELATED APPLICATIONS

This is a continuation-in-part (CIP) of (1) copending application Ser. No. 07/558,335, filed Jul. 27, 1990, now abandoned which is a CIP of copending application Ser. No. 07/521,011 ('011) filed May 9, 1990 now abandoned, which in turn is a CIP of copending applications (a) Ser. No. 07/324,705 ('705), filed Mar. 17, 1989, now abandoned, (b) Ser. No. 07/416,262 ('262), filed Oct. 3, 1989 now abandoned, which is a CIP of the '705 application, and (c) Ser. No. 07/480,586 ('586) now abandoned, filed Feb. 15, 1990, which in turn is a CIP of the '705 and '262 applications; (2) the '011 application; (3) the '262 application; and (4) the '586 application. The contents of all of these applications and any patents or other publications mentioned anywhere in this disclosure are hereby incorporated by reference in their entireties.

FIELD OF THE INVENTION

The present invention relates to athletic shoes and, more particularly, to athletic shoes wherein the upper thereof extends around the ankle bones, such as in high-top basketball shoes or high-top skates. The invention is also directed to systems which customize the fit of the shoe to the individual foot, such as the shoe upper around the ankle bones by means of pressurized collars or the individualized fit of the shoe to the arch or metatarsal areas of the foot. It is further concerned with pump assemblies for controllably and incrementally increasing the pressure in shoe bladders, and the construction of these pump assemblies.

BACKGROUND OF THE INVENTION

Current athletic shoes are a combination of many elements which have specific functions, all of which must work together for the support and protection of the foot during an athletic event. The shoes are designed to provide a unique and specific combination of traction, support and protection to enhance athletic performance. Shoes are designed for specific sports and also to meet the specific characteristics of the user. For example, athletic shoes are designed differently for heavier persons than for lighter persons, differently for wide feet than for narrow feet, differently for high arches than for lower arches, and so forth. Some shoes are designed to correct physical problems, such as overpronation, while others include devices, such an ankle supports, to prevent physical problems from developing.

Athletic shoes are divided into two general parts—an upper and a sole. The sole is attached to the bottom of the upper and provides traction, protection and a durable wear surface. The upper is designed to snugly and comfortably enclose the foot. In a running or jogging shoe, the upper typically terminates below the ankle bones and will have several layers including a weather and wear resistant outer layer of leather or synthetic material, such as nylon, and a soft padded inner liner for foot comfort. In athletic shoes designed for sports which require the athlete to make sudden and rapid lateral movements, such as in basketball, football, tennis or ice hockey, the upper frequently extends up to or above the ankle bones (the medial and lateral malleoli).

Such shoes are referred to as three-quarter height or high top shoes.

Attaining a proper fit around the ankle bones in three-quarter height and high-top athletic shoes has been a problem because the uneven contour around the ankle bones varies from person to person. The typical prior art technique for fitting the upper around the ankle bones has been to line the ankle portion of the upper with a relatively soft foam material. However, since no two persons have precisely the same ankle bone configuration, the foam material only approximates a customized fit.

The use of adjustable air-inflated bladders in the ankle portion of an upper is also found in the prior art. The most frequent use of such bladders is found in ski boots wherein the upper is relatively inflexible and the air bladders are designed to embrace the ankle and lower leg and provide a restraining force against the foot. Such air bladders typically form rigid vertical columns along the medial and lateral sides of the foot and leg, thereby restricting movement of the foot. While such restriction of motion is desirable in a ski boot, it interferes with required foot motion in athletic shoes designed for athletic activities such as basketball, football and tennis. West German Patents 2,365,329 and 2,308,547 disclose examples of such air bladders used in ski boots. As seen in FIGS. 4 and 5 of these patents, a separate tongue bladder and ankle bladder are provided, with the ankle bladder having cut out areas avoiding the malleoli and achilles tendon. However, as is typical in ankle bladders used in prior art ski boots, the ankle bladder forms relatively rigid vertical columns.

U.S. Pat. No. 3,758,964 ('964) relates particularly to ski boots and shows a bag member enclosed therein. Two chambers A and B are illustrated in FIG. 16 of the '964 patent. Chamber B forms an uninterrupted column of pressurized gas from the top to the bottom on both the medial and lateral sides; it also completely covers the malleoli. Chamber A, while not extending the entire vertical height, does form a restrictive column adjacent the malleoli. A different configuration for chambers A and B is depicted in FIG. 17 of the '964 patent. Chamber B therein forms a less substantial vertical column, but one would still form along the outer perimeter, anterior of the malleoli. Chamber A also forms a vertical column posterior to the malleoli. FIG. 18 of this patent shows two small chambers B and a large chamber A. While chambers B cover the malleoli thereby restricting movement, chamber A forms vertical columns posterior to the malleoli. These vertical columns are formed near the malleoli and thereby have a stiffening effect which restricts plantar and dorsi flexion of the foot. Although these restrictive vertical columns in covering of the malleoli are preferred for activities such as skiing where the foot must be secured in the boot, they actually reduce the athlete's performance in sports such as basketball, football, soccer, tennis and running. Studies have shown that an athlete's performance can be reduced when restrictions are placed on his plantar and dorsi flexion. See John F. Robinson et al., "Systematic Ankle Stabilization and the Effect on Performance," Medicine and Science in Sports and Exercise, Vol. 18, No. 6, 1986, pp. 625–628.

Examples of other shoes having bladders or similar arrangements include those disclosed in U.S. Pat. Nos. 1,313,924, 2,086,389, 2,365,807, 3,121,430, 3,469,576, 3,685,176, 3,854,228, 4,232,459, 4,361,969 and 4,662,087, in French 1.406.610 patent and PCT Publication WO 90/09115. See also U.K. application 2.111.821.A. Some of these designs include bladder placement which actually interferes with the fit of the foot in the shoe, some are not volume or pressure adjustable to provide a customized fit, some interfere with cushioning components of the shoe, some restrict the movement of the foot and some interfere with the pronation/supination action of the foot. None of them meets today's rigorous athletic standards, and none of them is especially well-suited for use in high top ice skates, basketball or tennis shoes.

An example of a recent inflatable shoe is THE PUMP basketball shoe available from Reebok. This shoe has a round molded rubber bulb pump on the tongue of the shoe and having an opening at one end and a one-way valve at the other end. A piece of tubing is stuck into that opening at one tubing end and the other tubing end is stuck into a flange attached to the shoe bag, which originally used reticulated foam therein, and held therein by adhesive. A duck-bill type of valve in the flange allows air to flow only from the bulb pump to the bag and not the other way. The deflation valve is a piece of tubing with one end welded to and sticking out of the bladder. The other tubing end is hooked to a molded plastic housing, and a metal-pin Schraeder-type tire deflation valve is secured in the housing.

A number of problems with this bladder-pump assembly have been experienced. Adhesives used to secure the pump and bag components together are often not reliable and are difficult to work with. For example, the adhesives have shelf lives, are affected by moisture, require clean application surfaces and can be contaminated when being mixed. If the pump is subjected to considerable flexing during athletic activity, the tube tends to pop out of it. To fix it requires that the shoe be torn open, and thus as a practical matter it is not repairable by the consumer. When excessive strain is applied, failure can also occur where the pump tubing enters the flange. Different size bladders for different shoes disadvantageously require different lengths of this comparatively rigid tubing. The deflation valve has numerous moving and connection parts and thus is unnecessarily likely to fail, difficult to assembly and bulky.

Reebok International Publication No. WO 90/04323 shows a shoe with an inflatable bladder wherein foam is provided in the pump cavity. This foam reduces considerably the pump volume, however. The inflatable bladder is in the tongue of the shoe, according to that disclosure, the reduce bumps caused by the shoe laces. This placement can reduce plantar and dorsi flexion, since the tongue area is thereby made thicker and can tend to bunch up when the foot is bent. While this is not a problem with rigid ski boots, it can reduce performance in athletic shoes. The tubes connecting the bladder chambers can by their connections provide possible failure areas.

L. A. Gear has recently introduced a line of shoes called THE REGULATOR which use a pump. The bladders are sewn into the tongue only, however. The bladder film comprises a 0.20 inch PVC heat sealed to form chambers. The pump comprises a rubber bulb pump with valves in the front and back, and a PVC extension tube welded to the bladder and cemented to the pump. The release valve is hooked on the pump nozzle end and is released by a sliding instead of a pushing action, and thus could be prone to accidental release. A one-way valve is press-fit into the back of the pump and locked on mechanically with a metal clip. This bladder when inflated tends to push down on the foot restricting plantar and dorsi flexion thereof.

SUMMARY OF THE INVENTION

The present invention is directed to an athletic shoe comprised of a sole and an upper attached to the sole. The upper includes an ankle portion extending around at least a portion of the area of the medial and lateral malleoli. An inflatable bladder is attached within the ankle portion of the upper and has a medial section, a lateral section and an inlet mechanism for supplying pressurized gas to the interior of the bladder. A mechanism is incorporated into both the medial and lateral sections of the bladder for preventing the formation of restrictive vertical columns of pressurized gas in the medial and lateral sections.

In one embodiment, the inflatable bladder is formed of two separate sheets or layers of elastomeric film connected to one another around the perimeter of the bladder. Polyurethane can be used, and it is also within the scope of the invention to make the bladder by blow molding. The medial and lateral sections of the bladder are both divided into upper and lower chambers by connection lines between the sheets of elastomeric film. The connection lines form the prevention mechanism and extend generally horizontally in each of the medial and lateral sections substantially along the entire horizontal extent of the lateral and medial sections in the area of the lateral and medial malleoli, respectively.

The medial and lateral sections of the inflatable bladder each have edges defining a cut out area. Each cut out area surrounds the area of a respective malleoli so that the medial and lateral malleoli are not covered by the inflatable bladder.

An athletic shoe incorporating the inflatable bladder of the present invention takes advantage of the adjustability of an inflatable bladder which can adapt itself to various ankle and leg configurations when pressurized, thereby providing a customized fit around any ankle. However, this advantage is obtained while alleviating the disadvantage of the rigidity found in prior art air bladders which formed relatively stiff vertical columns on either side of the ankle. Thus, the athletic shoe of the present invention can be comfortably worn in athletic activities, such as basketball, football and tennis, which require a high degree of flexibility for plantar and dorsi flexion.

Another embodiment of the present invention is particularly directed to high-top ice skates. The upper thereof includes an ankle portion extending around at least a portion of the area of the medial and lateral malleoli. One or more malleoli chambers are positioned in this shoe to fill in the areas below the malleoli. One or more arch chambers are positioned at the arch area in the shoe. Upper heel chambers fill in the areas behind and slightly above the malleoli. Each of these chambers is pressure adjustable through a valve stem accessible from outside the shoe. When inflated these chambers contour to the concavities of the foot adjacent the malleoli and at the arch without restricting the plantar of dorsi flexion of the foot.

A further embodiment of the present invention is especially useful in today's basketball shoes. The ankle bladder in the shoe is pressure adjustable by the user to provide an individualized fit and comfort. Air is pumped into the bladder by a lightweight pump assembly built into the lateral collar of the shoe. Since adhesives are not required in the assembly of and the attachment of the pump assembly to the bladder, failure is unlikely. The tubing communicating the squeezable bulb pump with the bladder connector comprises a flexible bellows integrally molded at one end with the bulb pump and affixed by mechanical securement means at the other end to the connector or weld flange. This means includes a barbed interference fit supplemented with a bail or wire retainer, and thus the bulb pump is a permanent part of the shoe. The flange of the connector is formed of a material compatible with the urethane bladder so that it can be RF welded in place thereon. The bellows being flexible and articulatable allow one size of built-in pump assembly to be used on shoe sizes eight to fourteen. A simple, reliable release valve RF welded to the bladder, spaced from the bladder connector and easily accessible at the outside back of the shoe allows the user to release pressure in the bladder, as needed.

When more than one bladder is used in a shoe, for example one for the arch and another for the ankle area, it is desirable to be able to separately inflate and deflate them to different pressures to accommodate different feet and fits. Thus, a still further embodiment provides a novel valve mechanism. A dial of this mechanism, conveniently positioned on the lateral side of the upper, can be turned to any of three positions. When in the first position, the depressible plunger of the valve mechanism and the articulatable on-board pump can be operated to adjust the pressure only in one chamber. When in the second position, the plunger and pump can be operated to adjust the pressure only in the other chamber. And when in the third position, neither the pump nor the plunger can be operated which prevents any unintentional pressure change in either of the chambers. The chambers, the valve mechanism and the pump are assembled as an interconnected assembly. The plunger barrel of the valve mechanism is snap fit into a ring-tee member unit affixed to the upper. The interconnected assembly is thereby automatically and properly positioned and oriented in the shoe.

In other words, disclosed herein is a bladder assembly for an athletic shoe and having at least first and second chambers. The chambers are independently and separately pressure adjustable by the user to conform to different concavity areas of his foot, such as the arch, ankle and metatarsal areas, to thereby enhance fit, comfort and athletic performance. Both chambers are inflatable by the same articulated on-board pump and deflatable by the same on-board depressible plunger. A dial on the lateral side of the upper allows the user to select which of the chambers is to be pressure adjusted, that is, which of the chambers is in pressure communication with the pump and the plunger. When the dial is in a neutral position, accidental inflation or deflation of either chamber is prevented.

Various advantages and features of novelty which characterize the invention are pointed out with particularly in the claims annexed hereto and forming a part hereof. However, for a better understanding of the invention, its advantages and objects obtained by its use, reference should be had to the drawings which form a further part hereof and to the accompanying descriptive matter in which there is illustrated and described a number of preferred embodiments of the invention.

DETAILED DESCRIPTION OF PREFERRED EMBODIMENTS OF THE INVENTION

Figure 1:
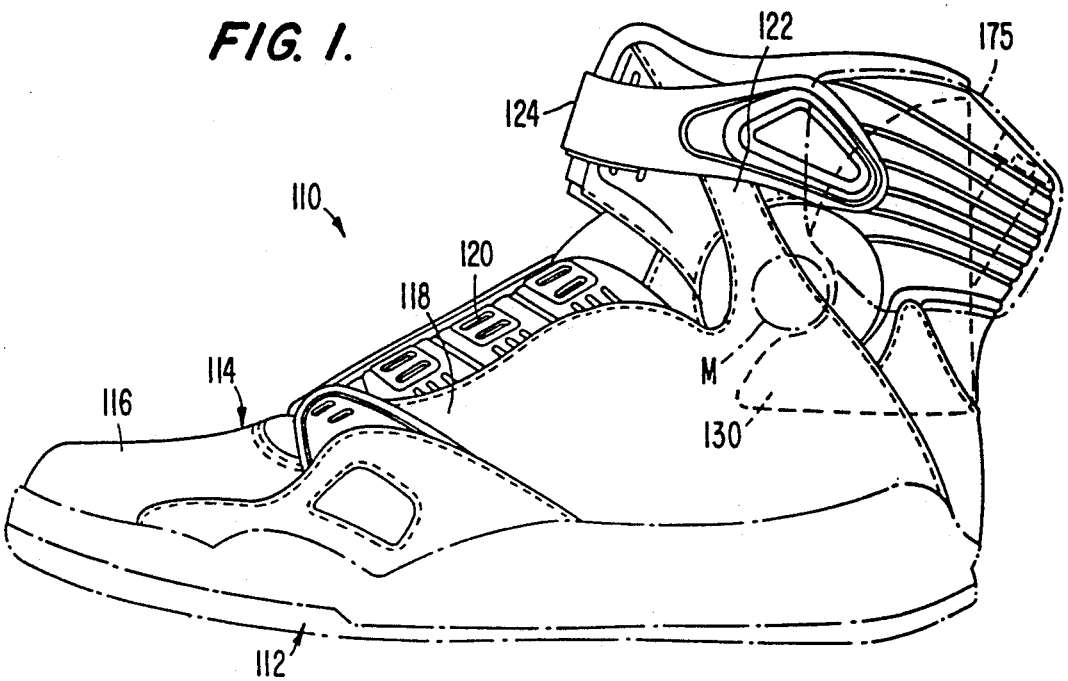
FIG. 1 is a lateral side view of an athletic shoe of the present invention illustrating the inflatable bladder thereof in dashed line.
Figure 2:
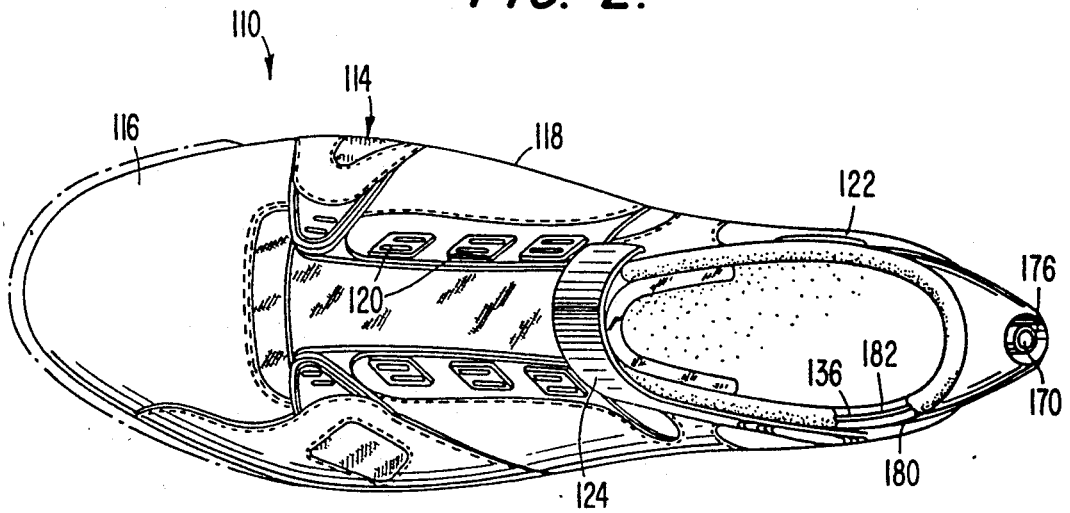
FIG. 2 is a top plan view of the athletic shoe of FIG. 1, partially broken away, illustrating the inflatable bladder between an outer layer and inner liner of the upper.

Referring to the drawings, wherein like numerals indicate like elements, there is illustrated in FIGS. 1 and 2 an athletic shoe 110 in accordance with the present invention. Shoe 110 includes a sole 112 attached in a conventional manner, for example, by an adhesive, to an upper 114. Shoe 110 is preferably a high top type of athletic shoe wherein upper 114 extends around and above the medial and lateral malleoli, indicated as M in FIGS. 1 and 4. Sole 112 is a cup-type sole wherein a portion of the sole extends around the sides of upper 114. Upper 114 includes a toe portion 116, extending around the area of the toes, an instep portion 118 extending around the instep portion of the foot and including lacing eyelets 120 and an ankle portion 122 extending around the ankle and lower leg. Ankle portion 122 also includes lacing eyelets 120 and a tightening strap 124.

Figure 3:
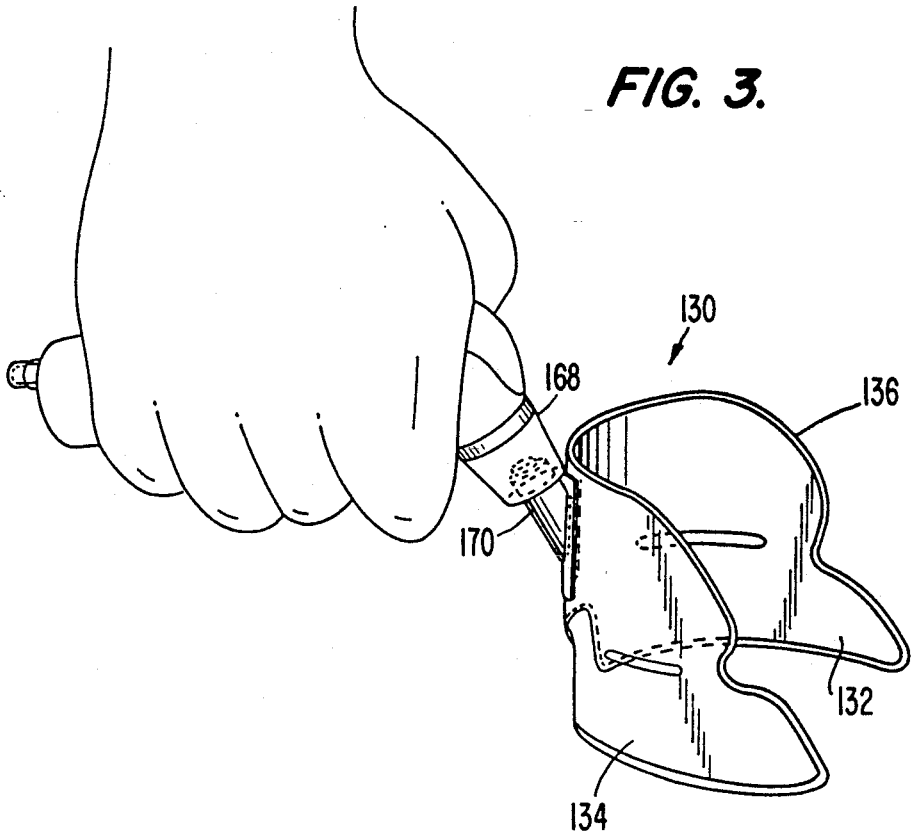
FIG. 3 is a perspective view of the inflatable bladder of FIG. 1 connected to a hand pump.
Figure 4:
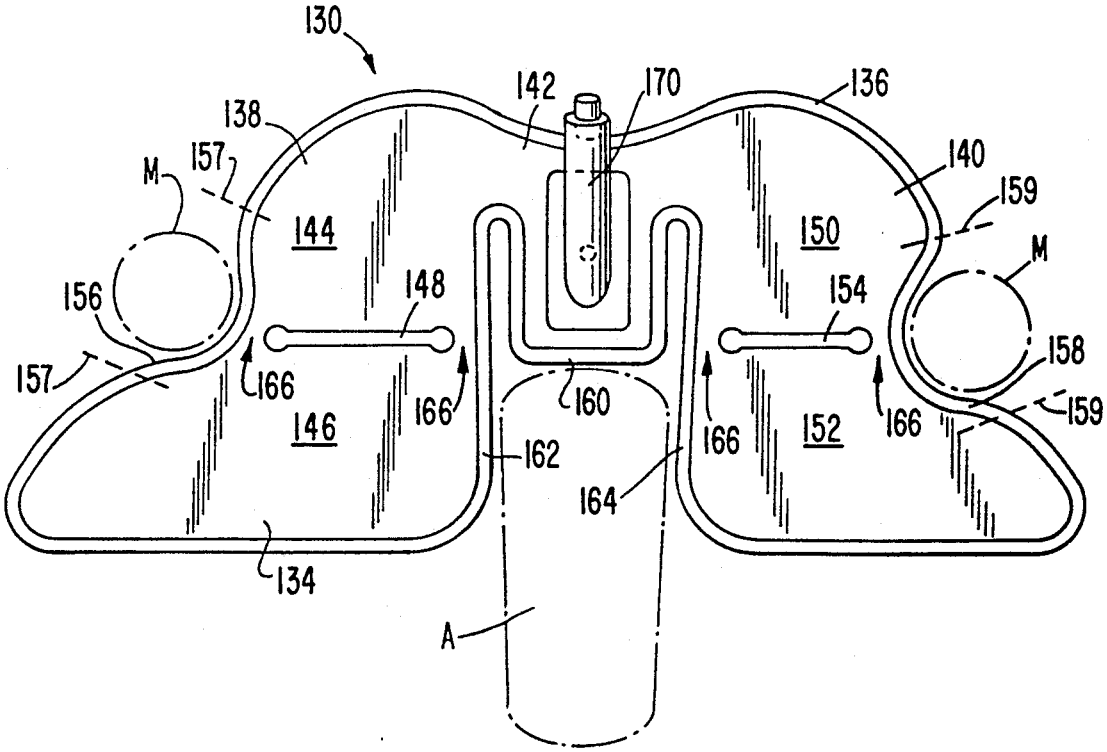
FIG. 4 is a plan view of the inflatable bladder extended flat, with portions of a foot and leg anatomy shown diagrammatically in phantom lines.

An inflatable bladder 130 is attached to ankle portion 122 of upper 114, and details thereof are best seen in FIGS. 3 and 4. Bladder 130 is formed of two separate sheets or layers of elastomeric film, an inside layer 132 and an outside layer 134, which are sealed together along their perimeter edges 136. Bladder 130 has a medial section 138, a lateral section 140 and a small rear section 142 in fluid communication between the medial and lateral sections. Medial section 138 is divided into an upper portion 144 and a lower portion 146 by a divider formed of a weld line 148 connecting inner and outer layers 132 and 134. Lateral section 140 is similarly divided into an upper portion 150 and a lower portion 152 by a divider formed of a weld line 154 connecting inner and outer layers 132 and 134.

When bladder 130 is incorporated into ankle portion 122, weld line 148 is in vertical alignment with the area of the medial malleoli M as shown diagrammatically in FIG. 4, and weld line 154 is vertically aligned with the area of lateral malleoli M, also as illustrated in FIG. 4. Similarly, as illustrated diagrammatically in FIG. 4, perimeter 136 on the medial side defines a cut out area 156, approximately between dash lines 157, which surrounds the area of the medial malleoli so that the bladder does not cover the medial malleoli. On the lateral side, perimeter 136 also defines a lateral cut out area 158, approximately between dashed lines 159, which surrounds the area of the lateral malleoli so that bladder 130 does not cover or extend over the lateral malleoli.

A lowermost edge 160 or rear section 142 is located above the achilles tendon area, indicated diagrammatically as A in FIG. 4, and the medial and lateral sections 138, 140 have rearward edges 162 and 164 disposed to the sides of achilles tendon area A so that no portion of inflatable bladder 130 overlies the achilles tendon.

Weld lines 148 and 154 function as dividers in the medial and lateral sections and performs the critical function of preventing the formation of vertical columns of pressurized gas on the medial and lateral sides. Such pressurized vertical columns would unduly restrict the motion of the foot and ankle. To perform this prevention function, medial weld line 148 extends horizontally along substantially the entire extent of medial section 138 in the area of medial malleoli M so that only small areas of fluid communication 166 remain between upper and lower portions 144 and 146. Similarly, weld line 154 extends horizontally along substantially the entire width of lateral section 140 in the area of the lateral malleoli so that only small fluid communication areas 166 exist between upper and lower portions 150 and 152. These small areas 166 are insufficient to allow the formation of rigid vertical columns of pressurized air.

As seen in FIG. 3, bladder 130 is bent in a generally U-shaped configuration for incorporation into ankle portion 122. In order to inflate bladder 130, a pump, such as hand pump 168, is connected to a valve 170 extending from rear section 142 and ambient air is pumped through the valve. Inflatable bladder 130 is incorporated into ankle portion 122 between an outer layer 180 of the upper and an inner liner 182 of the upper. A portion of outer layer 180 of the upper, in the area indicated generally by dot and dash line 175, can be formed into a pre-shaped shroud from a relatively high density foam material and may include an aperture 176 through which valve 170 extends and can be accessed by hand pump 168. Since the shroud is formed of a high density foam material, for example 0.2–0.4 gm/cm$^3$, it takes on a relatively fixed, but flexible configuration. When inflated by hand pump 168, medial and lateral sections 138 and 140 expand to fill in the areas surrounding the medial and lateral malleoli to provide a comfortable fit for the high-top portion of the upper. However, since weld lines 148 and 154 prevent the formation of pressurized vertical columns, plantar and dorsi flexion are not thereby restricted.

Figure 5:
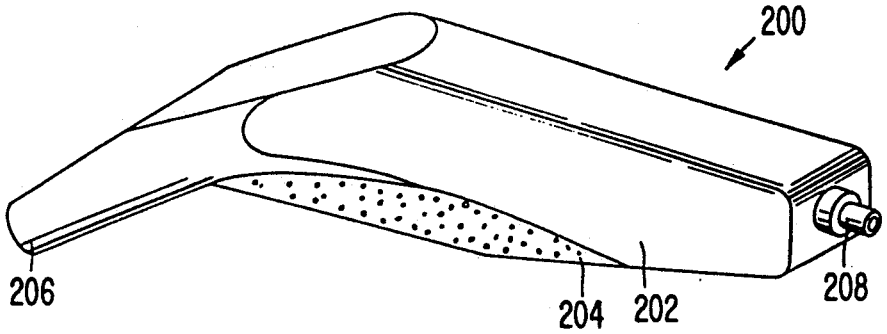
FIG. 5 is a perspective view illustrating in isolation a hand pump of the present invention.

A preferred hand pump 168 of the present invention is illustrated in isolation in FIG. 5 generally at 200. It is seen therein to include a pump body 202 of a flexible plastic material which can be easily grasped and controllably compressed by a hand squeeze and when the pressure of the hand squeeze is released returns to its normal expanded position. The body 202 further includes a bumpy and raised lower surface 204 providing a friction surface to be easily held in the user's hand. When the pump body 202 is compressed, air in the body is expelled or forced out of the outlet end 206. When it is subsequently released, the air is sucked in through the opposite inlet end 208.

Both inlet and outlet ends 208, 206 include internal sliding rods which slide within their nozzle housings between open and closed positions relative to their openings as needed for the pumping action. A sample valve housing for the outlet end 206 and in which the outlet rod slides is shown in isolation in FIGS. 11–13 generally at 210. When released, the outlet plug or rod, which is shown at 211 in FIG. 12, is then sucked or drawn inward to a position spaced from the prongs 212 closing the opening. The prongs or cross-bars 212 provide an abutment surface for depressing the valve assembly shown generally at 214 to open it so that air can be injected into the bladder 216. Similarly, the sliding rod of the inlet end 208 slides to an open position when the pump body 202 is released to allow air to be sucked in through the opening. At that time the outlet end 206 is in a closed position by the outlet rod. When the body 202 is compressed, the sliding inlet rod is forced outwardly to close the inlet end 208 so that all of the expelled air pressure is expelled through the outlet end 206.

Figure 6:
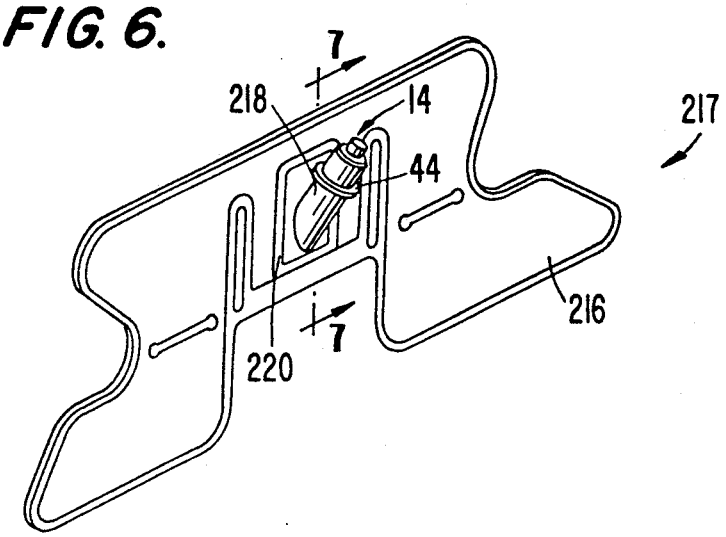
FIG. 6 is a perspective view illustrating in isolation an alternative bladder and valve assembly of the present invention.
Figure 7:
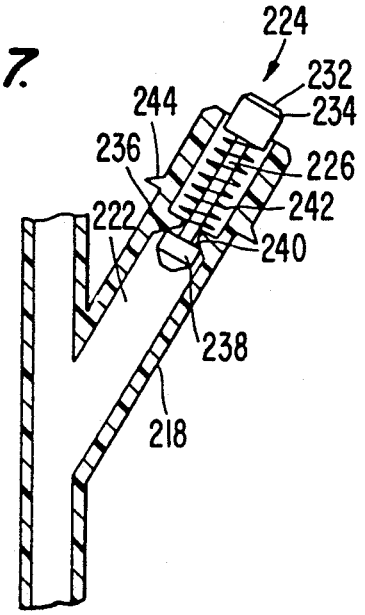
FIG. 7 is a cross-sectional view taken along line 7—7 of FIG. 6.
Figure 8:
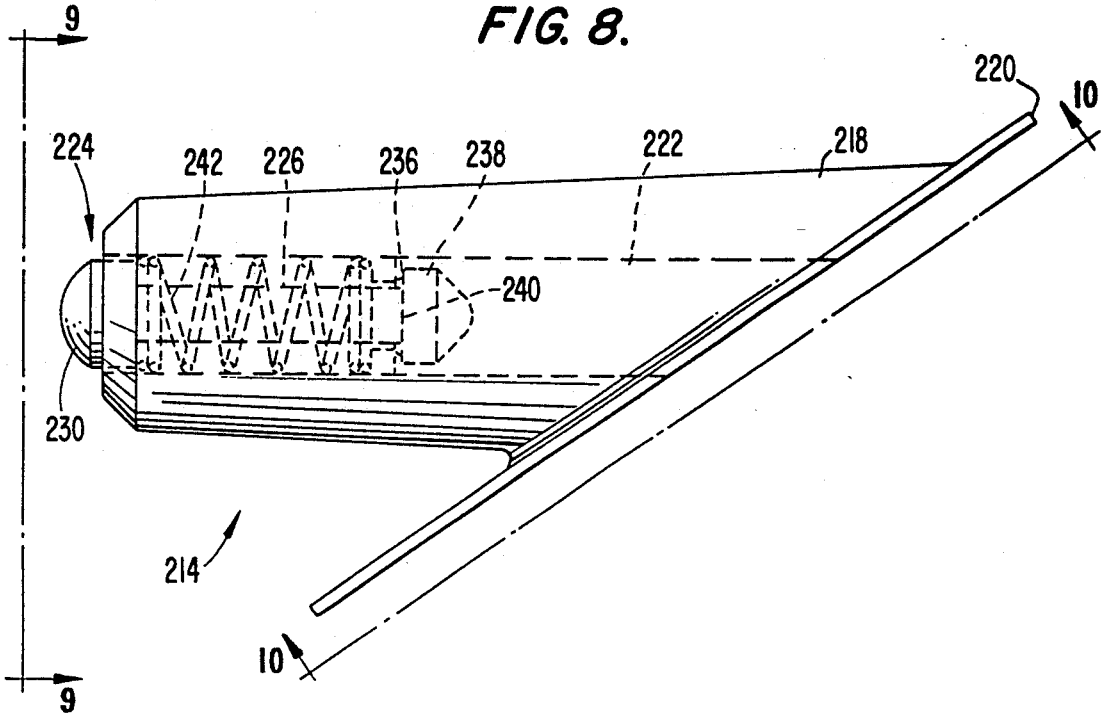
FIG. 8 is a side elevational view of an alternative valve assembly which can be used, for example, on the bladders of FIGS. 3, 4 or 6.
Figure 9:
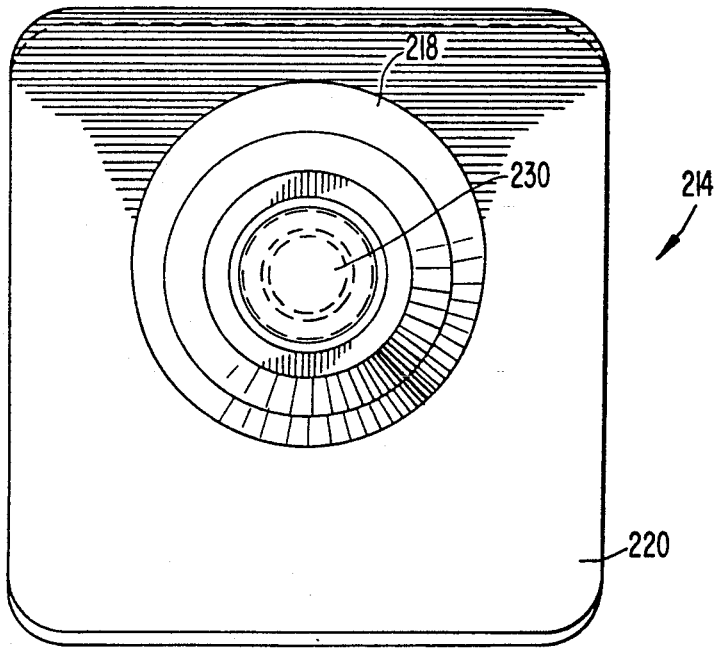
FIG. 9 is a view taken on line 9—9 of FIG. 8.
Figure 10:
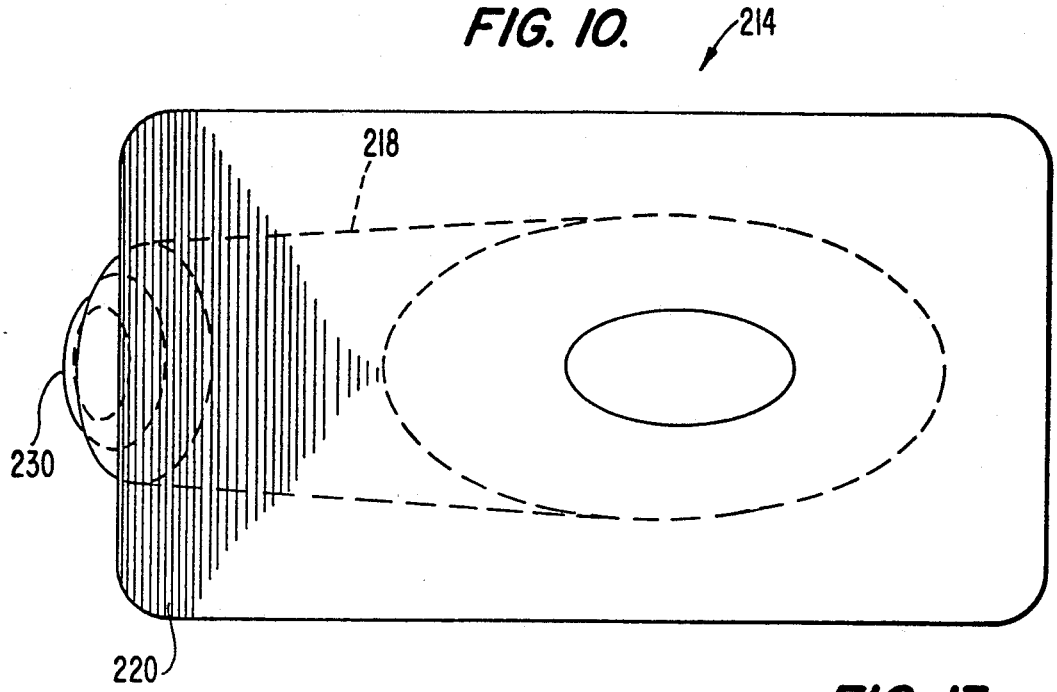
FIG. 10 is a view taken on line 10—10 of FIG. 8.

A bladder and valve assembly of the present invention is shown in FIG. 6 generally at 217. Description of the bladder portion thereof shown generally at 216 is provided with respect to the embodiment illustrated in FIG. 4. The construction and operation of the valve assembly 214 will now be described with reference to FIGS. 6 and 7 as well as a variation thereon as depicted in FIGS. 8–10, and differences between them will also be mentioned. In other words, valve assembly 214 can be substituted for or shows in greater detail the valve 170. The valve assembly 214 uses a firm, but compliant, elongated housing 218 of urethane (Shore A80–90) which is compatible with the urethane film bladder 216. This compatibility allows it to be RF welded in place along the peripheral flange 220. The housing 218 has an air passageway 222 therethrough and in which is secured a spring-biased valve stem assembly shown generally at 224. This valve stem assembly 224 includes an aluminum valve stem 226 having a broad smooth tip 228 which is easy to manipulate with the user's finger tip. The tip 228 can either be rounded as shown in FIGS. 8 and 9 at 230 or have a flat surface 232 with a beveled edge 234 as best shown in FIG. 7. The valve body or housing 218 has a conical-shaped seat area 236, and thus the molded valve housing advantageously functions as the valve seat. The inner end of the valve stem 226 defines an enlarged body member 238 having a flat surface 240. This flat surface-conical seat area, in contrast to a conical valve body head, allows for more sealing pressure to be applied and a more compliant spring to be used while still obtaining an adequate seal. This is important when the valve assembly is operated by a person's finger as it is in the present case.

The spring, as shown in FIGS. 6 and 8 at 242, encircles the valve stem 226 and can, for example, be a "302" SST (or plated music) wire compression spring having an outer diameter of 4.86 (or 4.57) millimeters, a wire diameter of 0.48 (or 0.36) millimeters, a free length of 18.34 (or 12.7) millimeters and a spring rate of 0.162 (or 0.49) kilograms per millimeter (or 9.08 lbs/in). When the broad smooth tip 228 of the valve stem 226 is manipulated or pressed down with a finger tip or by other means, the valve stem is pressed inwardly and the plunger end 238 moved inwardly away from the valve seat 236 allowing air to flow therethrough. The valve assembly 214 of FIGS. 6 and 7, unlike that of FIGS. 8–10, has an annular abutment shoulder 244, against which the end of outlet end 206 abuts when hand pump 200 is slipped into place on valve housing 218 for inflating bladder 216 (or bladder 130), as will be explained in greater detail in conjunction with FIGS. 14 and 15.

Thus, unlike standard freon or push-to-deflate valves which are designed to be held together by a crimped metal housing and then attached to a metal can, the valve of the present invention can be connected to the present urethane film bladder. The standard valve is further difficult and uncomfortable to release pressure therefrom by using only one's finger tip.

A standard tire or Schraeder valve, which uses a metal pin and rubber gasket assembly inside of a metal housing, has a valve stem which can be somewhat easier to depress than is the push-to-deflate-valve. However, the metal housing of the Schraeder valve is not readily combinable with the present urethane film, unlike the valve of the present invention.

A needle or Voit type of valve requires a needle to be inserted through a rubber stem for inflation and deflation procedures. This type of valve is difficult, however, to manipulate when a fine pressure adjustment is desired, such as is required in the present footwear application. It is also difficult to regulate the amount of air released by the needle valve from the inflated object inasmuch as that valve is either fully closed or fully open. The needle valve, however, can be made in a material suitable for bonding or welding to a urethane bladder.

One way or check valves which allow flow in only one direction are commonly found in medical devices such as syringes and bulb pumps. A typical check valve has a hard outer housing of metal and plastic and a softer, rubber-like component which seals the valve when air pressure pushes against it. These valves, however, are not suitable for the present purposes since they cannot release air slowly and accurately and since they act in only one direction.

Figure 11:
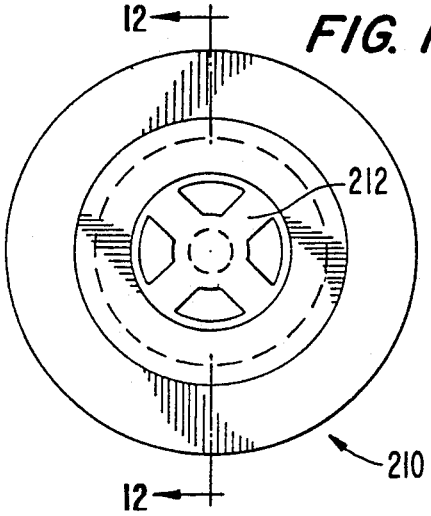
FIG. 11 is an interior end view of a pump nozzle of the hand pump of FIG. 5.
Figure 13:
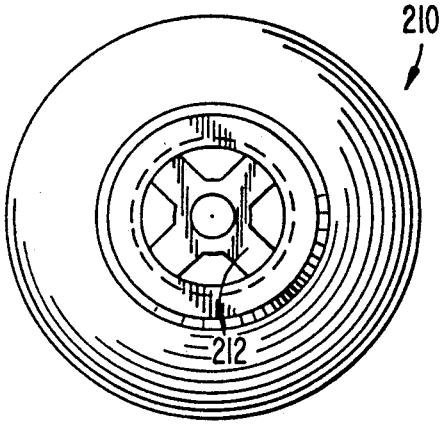
FIG. 13 is an end view of the opposite end of the nozzle of FIG. 5.
Figure 12:
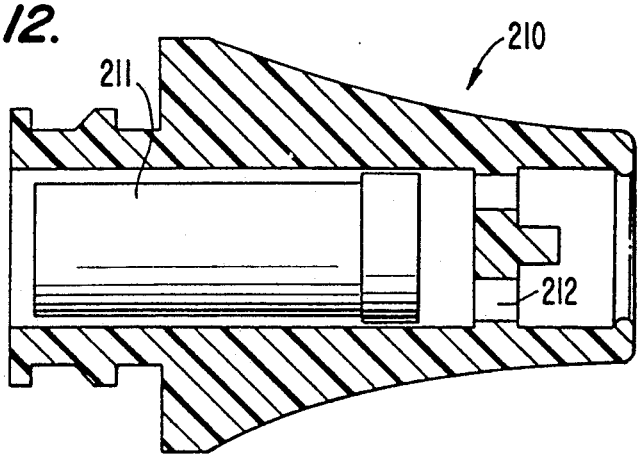
FIG. 12 is a cross-sectional view taken along line 12—12 of FIG. 11.
Figure 14:
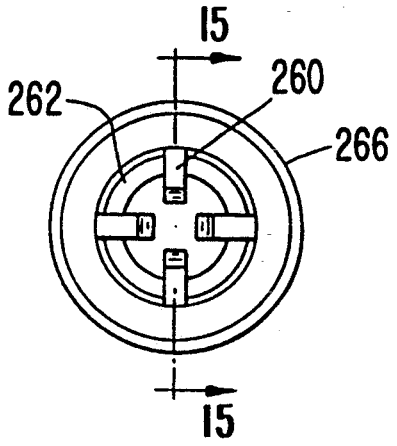
FIG. 14 is an end view of an alternative preferred outlet for the hand pump of FIG. 5.
Figure 15:
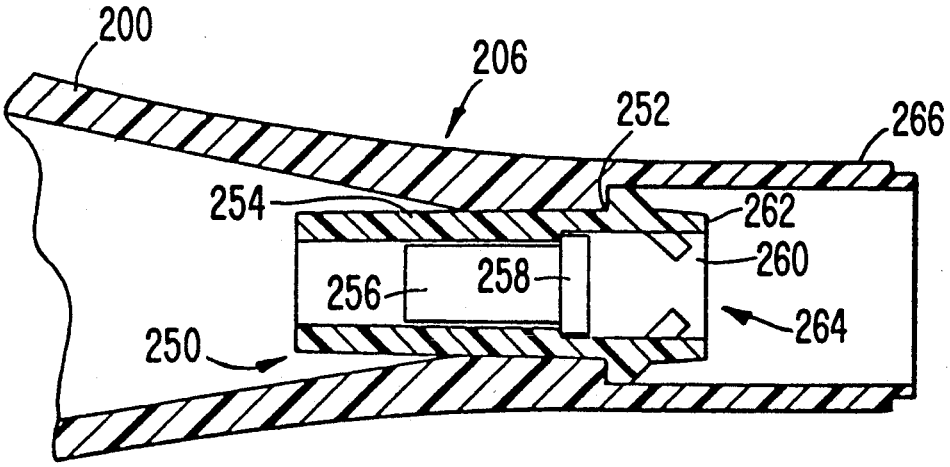
FIG. 15 is a cross-sectional view taken along line 15—15 of FIG. 14 of an alternative preferred outlet end for the hand pump of FIG. 5.

FIGS. 11–13 illustrate one outlet nozzle of the present invention having a connector end (at the left FIG. 12) adapted to be attached to the body of the hand pump 200. An alternative and preferred outlet nozzle arrangement is illustrated in FIGS. 14 and 15. These two figures show the outlet end 206 of the hand pump 200 with a nozzle 250 built therein against the interior pump shoulder 252. The nozzle 250 defines a cylinder 254 in which plug 256 slides. When in an outward position the head 258 of plug 256 engages the four cross prongs 260. The cross prongs 260 extend radially inward and also angle outward relative to the axis of the cylinder 254, as can be understood from FIGS. 14 and 15. The prongs 260 and the distal end 262 of the cylinder define a seat 264. When the sleeve end 266 of the outlet end 206 is slipped onto and over the elongated housing 218 generally up to the abutment shoulder 244, the seat 264 impacts the tip 228. The valve stem assembly 224 is thereby depressed and the valve assembly 214 opened so that air can be injected by the hand pump 200 into the bladder 216.

Thus, the disclosed valve and pump system is advantageous over the prior art systems because of the reduced number of parts needed. No connectors, extenders or the like are required, and no connecting hose between the pump and the valve is needed since the one-way valve in the nozzle of the pump actuates the valve. A perfect air-tight seal therebetween is not necessary since the pressures and volumes involved are quite small as can be appreciated. Since the system has few moving parts, it is very reliable. Inflation and deflation of the bladder can be easily and accurately accomplished with the present system.

Figure 16:
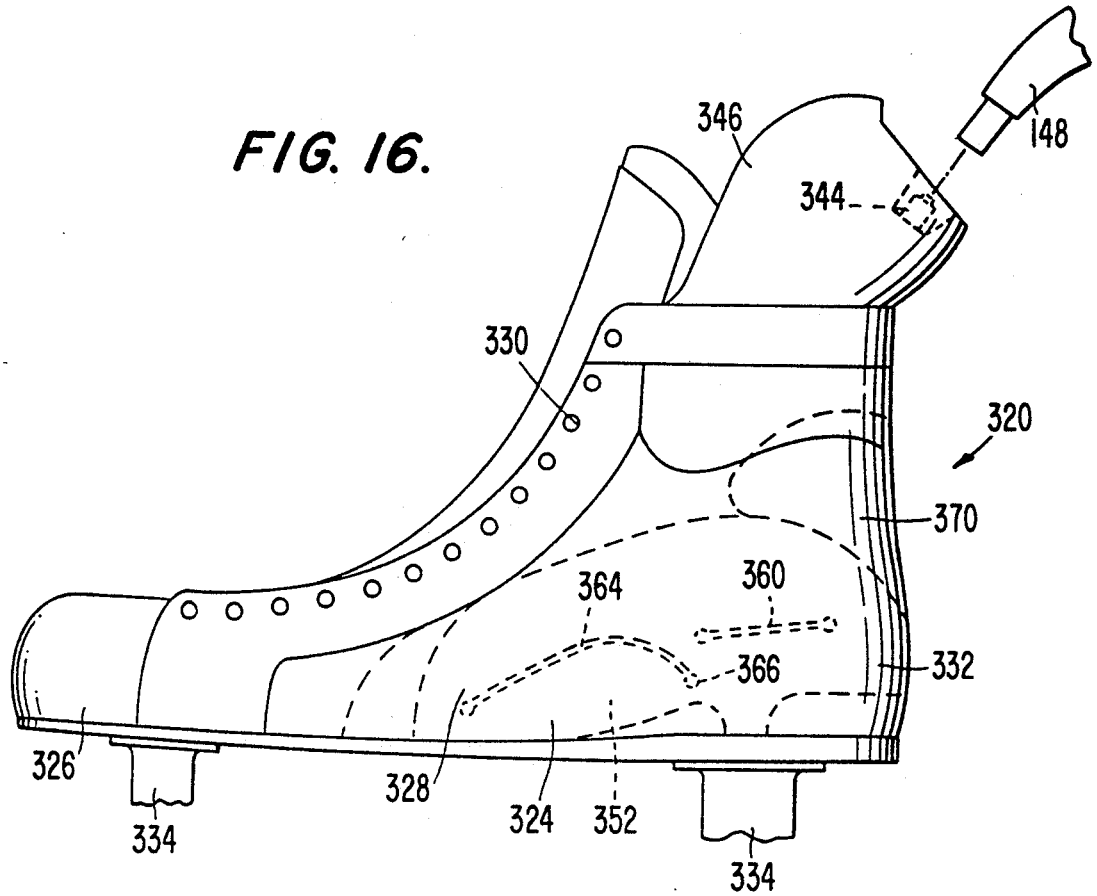
FIG. 16 is a side elevational view of a shoe, particularly a high-top ice skate, of the present invention which includes an alternate inflatable bladder system.
Figure 17:
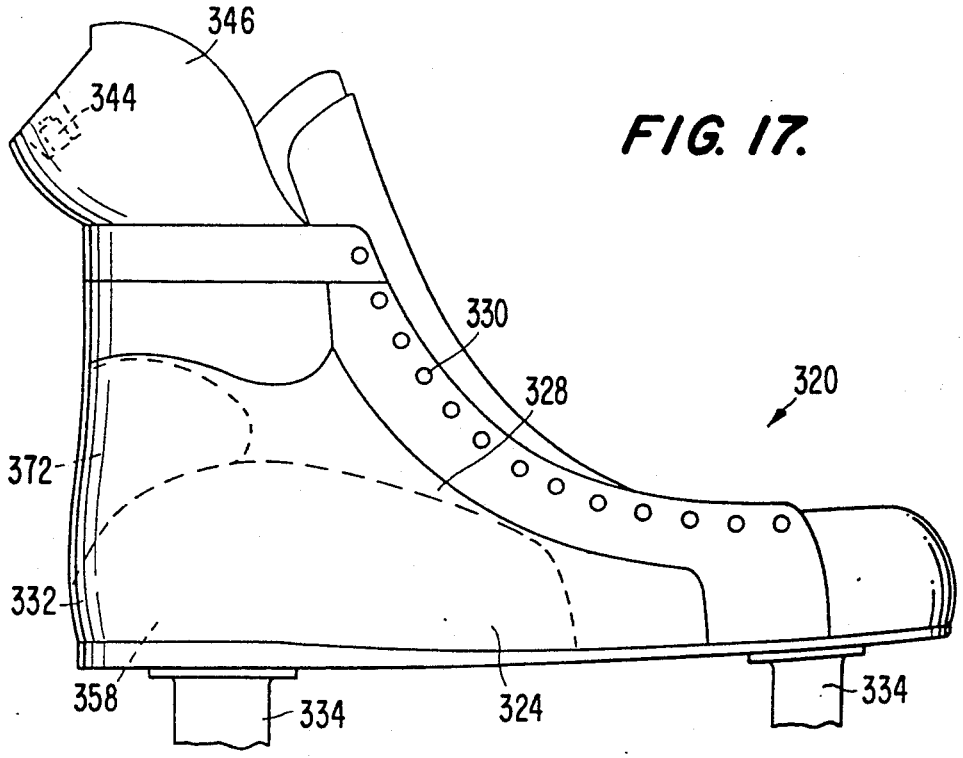
FIG. 17 is a side elevational view of the opposite side of the shoe of FIG. 16.
Figure 18:
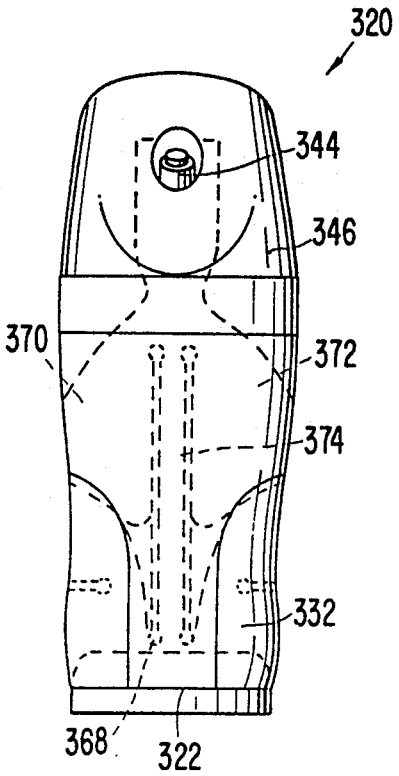
FIG. 18 is a rear elevational view of the shoe of FIG. 16.
Figure 20:
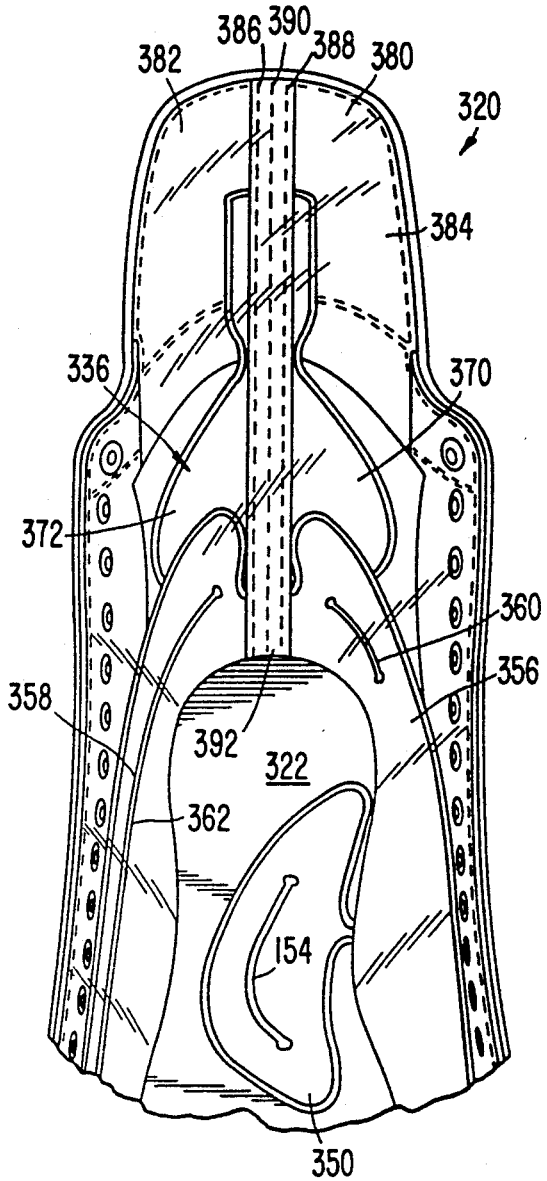
FIG. 20 is a top perspective view of the forward portion of the shoe of FIG. 16, with the tongue thereof pulled forward to more clearly illustrate the bladder system therein.

FIGS. 16, 17 and 20 illustrate an alternative embodiment of an athletic shoe shown generally at 320 in accordance with the present invention. Shoe 320 includes a sole 322 attached in a conventional manner to an upper 324. The shoe 320 is preferably a high-top type of athletic shoe wherein the upper 324 extends around and above the medial and lateral malleoli, indicated as M in FIG. 21. The upper 324 includes a toe portion 326 extending around the area of the toes, an instep portion 328 extending around the instep portion of the foot and including lacing eyelets 330, and an ankle portion 332 extending around the ankle and lower leg. A skate blade 334, whose upper portions are depicted in FIGS. 16 and 17, can be secured beneath the sole 322 so that the shoe 320 thereby forms an ice skate.

Figure 21:
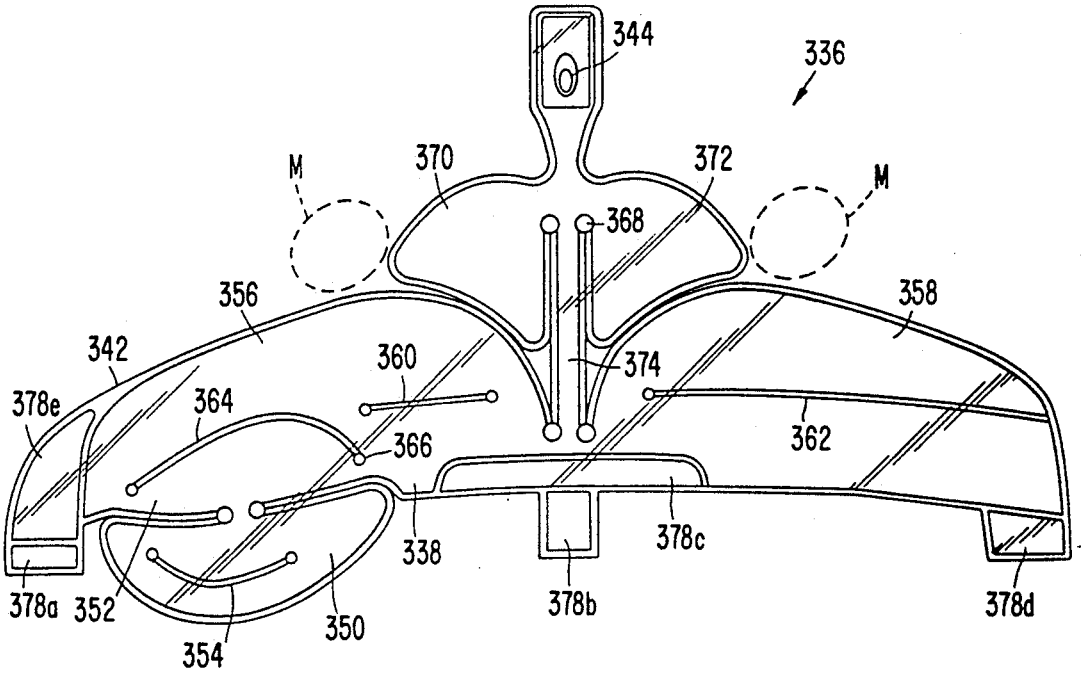
FIG. 21 is a plan view of the inflatable bladder system of the shoe of FIG. 16 shown extended flat and in isolation.

An inflatable air bladder assembly, shown for example in isolation in FIG. 21 generally at 336, is attached inside of the shoe 320 to the upper 324. The bladder assembly 336 is formed of two separate sheets or layers of elastomeric film—an inside layer 338 and an outside layer—which are sealed together along their perimeter edges 342. The air bladder assembly 336 includes a plurality of chambers inflatable to different degrees and positioned to correspond to different concavity areas of the foot. These chambers are connected by air passageways and separated by weld lines, and some are further divided into pockets or subchambers, as will be explained below, to further enhance the fit. Although the chambers are separate and can be inflated to different degrees to accommodate differently configured feet, they are inflatable through the same nozzle or valve stem as shown generally at 344 at the top of the bladder assembly 336. The nozzle or valve stem 344 is preferably of the type illustrated in FIGS. 6–10 and inflated by a pump such as illustrated in FIGS. 5 and 11–15. The valve stem 344 can be located, however, at generally any other convenient location on the shoe 320. It is also within the scope of this invention to provide independent valves for one or more of these chambers.

The valve stem 344 extends out the back of the shoe 320 to be accessible from outside of the shoe. A preshaped shroud 346 of a relatively high density foam material is secured to the upper 324 at the upper top portion of the shoe 320. The shroud 346 has an aperture therethrough through which the valve stem 344 extends to be accessed for inflation and deflation of the chambers of the bladder assembly 336. Since the shroud 346 is formed of a high density foam material, it takes on a relatively fixed, but flexible configuration. The amount of air and thus pressure in each of the chambers can be finely and accurately adjusted by inflating the bladder assembly 336 through the valve stem 344 by gently squeezing the hand pump 200. Accurate deflation then can be made by lightly pressing, as with the finger tip or the opposite end of the hand pump 200, the push-to-deflate nozzle of valve stem 344. In lieu of air, any suitable free-flowing, non-setting fluid can be used to controllably adjust the size and pressure of the chambers.

Figure 19:
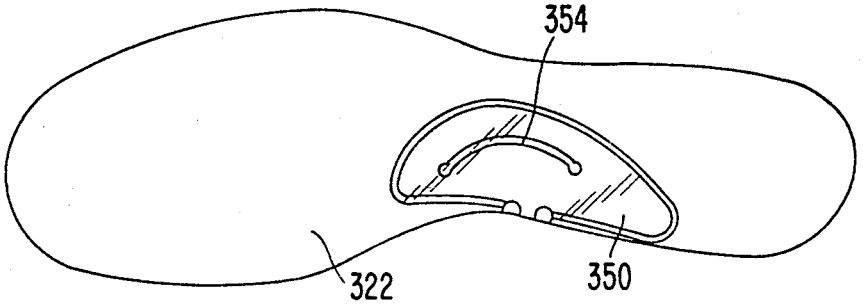
FIG. 19 is a top plan view of the sole of the shoe of FIG. 16 and a portion of the bladder system thereon, illustrated in isolation.

The bladder assembly 336 is divided into a plurality of chambers, as can be seen for example in FIGS. 20 and 21. The arch chamber 350, as can also be seen in FIGS. 16 and 19, has its function augmented by the side arch chamber 352, which is positioned towards the medial side of the foot. These two chambers 350, 352 combine to completely fill in the arch area of the foot. A curved contouring weld 354 centrally positioned in the arch chamber 350 provides an additional contouring fit function. A pair of malleoli or lower heel chambers 356, 358 extend forward to the arch area along the sides of the foot. The malleoli or lower heel chambers 356, 358 are subdivided by contouring welds 360, 362 to provide a contoured filling in of the area of the foot below the malleoli. The heel chamber 356 is separated from the side arch chamber 352 by a contoured weld 364. Weld posts are provided at the free ends of the weld lines—either a relatively small post as shown at 366 or a larger post as shown at 368 for the double or folded layer ends.

Upper heel chambers 370 and 372 for filling in the areas of the foot behind and slightly above the malleoli are provided at the top of the bladder assembly 336 below the valve stem 344. Umbilical passageway or tube 374 extends from the upper heel chambers 370, 372 to the malleoli or lower heel chambers 356, 358. Although this tube 374 is narrow enough to not actually or significantly inflate when the bladder assembly 336 is pressurized, it is wide enough to allow air to pass freely through it thereby communicating the various bladder chambers. The bladder assembly 336 thus fills in the cavities of the arch and ankle of the foot to enhance the fit of the shoe to the foot, rather than to cushion the foot. The bladder assembly 336 does not extend around the entire foot as to interfere with the fit and particularly does not restrict the plantar and dorsi flexion of the foot. In other words, the numerous chambers within this bladder assembly 336 contour the bladder assembly to the anatomy of the foot without restricting the motion of the foot.

A plurality of tabs 378*a*, 378*b*, 378*c*, 378*d* and 378*e*, as best shown in FIG. 21, extend out from the chambers for stitching the bladder assembly 336 in place in the shoe 320 to the shoe upper 324, and are not themselves inflated. As seen in FIG. 20, a liner 380, preferably a flexible, clear plastic liner, is secured to and in the upper 324 and positioned between the bladder assembly 336 and the foot. This liner 380 allows the foot to be easily slipped into and out of the shoe 320 without dislodging, damaging or getting caught up on any of the chambers of the bladder assembly 336. The liner 380 can be comprised of a pair of flexible sheets 382, 384 stitched along the edges of the upper 324 on both sides thereof. The rear vertical edges of the two sheets 382, 384 are stitched to one or two interconnected elongated webs 386, 388 secured at the top 390 and the bottom 392 of the upper 324 and not fixed along their lengths to the upper 324 so as to not restrict the inflating and deflating movement of the enclosed bladder assembly 336.

Alternatively, this bladder assembly 336 can be molded in place in a polyurethane or latex sockliner or adhered to an EVA or PEEVA liner. Fabric or foam can be applied to the inner surfaces of the chambers to provide slip resistance and comfort to the foot as when the plastic liner is not used. The bladder assembly 336 can be attached to the bottom of a foam sockliner. The heel area and the forefoot area can be left completely exposed to prevent this assembly from interfering with the cushioning of the foot.

Figure 22:
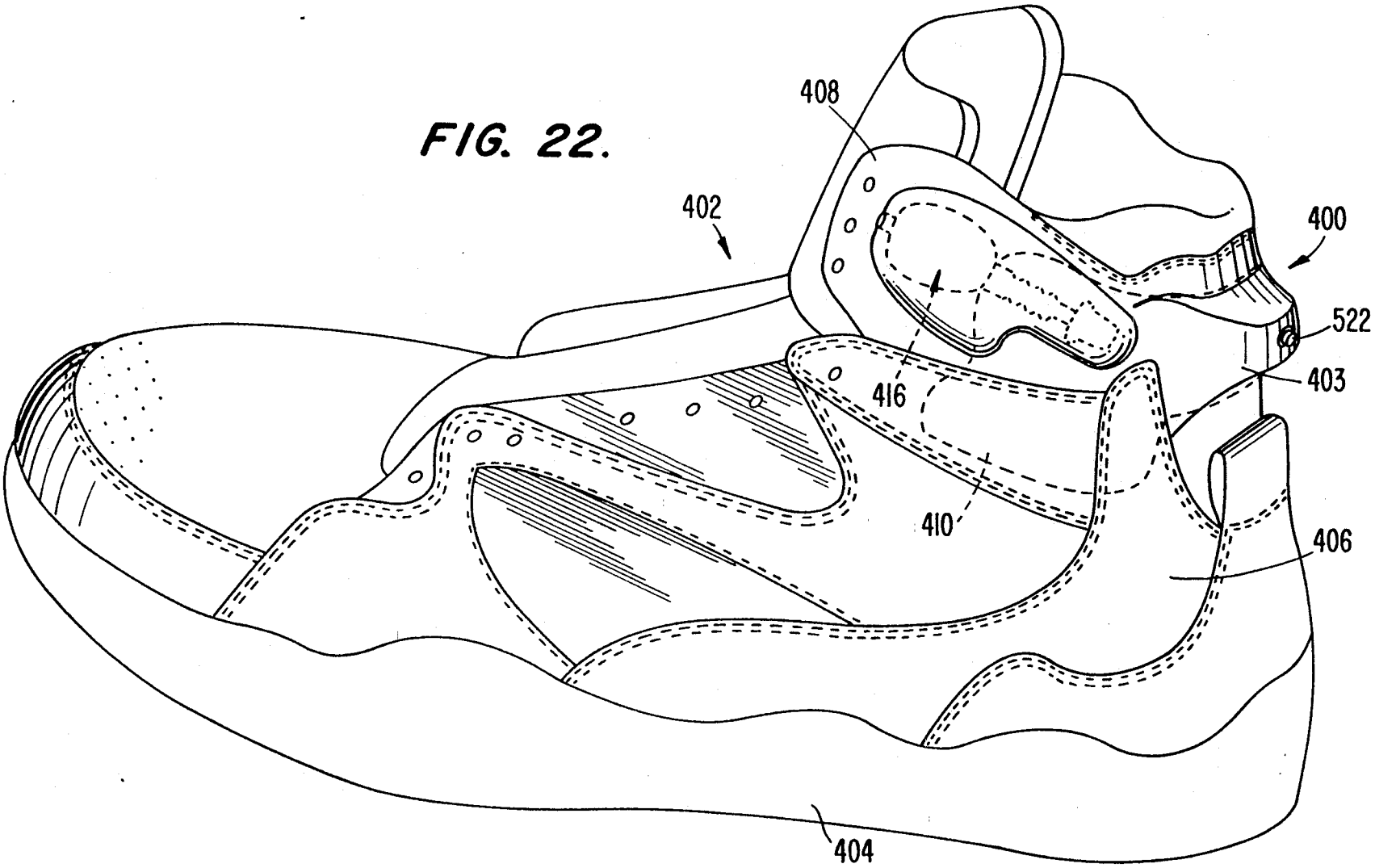
FIG. 22 is a perspective view of a shoe with an alternative bladder pump assembly of the present invention built into it.
Figure 23:
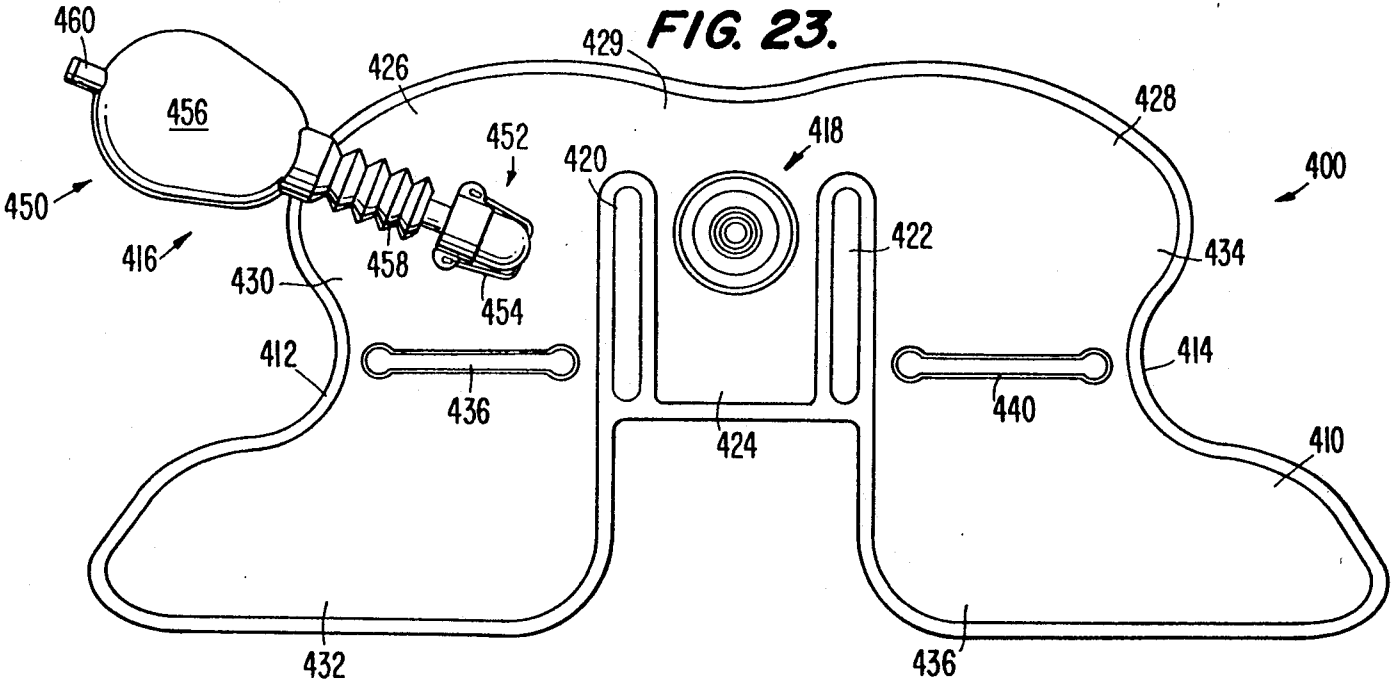
FIG. 23 is a top plan view of the bladder pump assembly of FIG. 22 shown in isolation and laid flat.

A built-in bladder pump assembly embodiment of the present invention is illustrated generally at 400 in FIG. 22 and shown built into a shoe illustrated generally at 402, using a shroud 403. The shoe 402 is shown generically and is preferably a high-top basketball shoe. Examples of such shoes are the AIR FORCE FIVE as illustrated in the Nike Fall '90 Catalog and the AIR COMMAND FORCE as shown in the Nike Holiday 1990 Catalog. Shoe 402 comprises basically a sole shown generally at 404 and an upper shown generally at 406 and including a collar 408. The procedure for incorporating the bladder pump assembly 400 into the shoe will be described later, and with particular reference to FIGS. 41–43. The bladder pump assembly 400 is shown in isolation and laid flat in FIG. 23. Referring thereto it is seen to comprise a single unit including an ankle bag or bladder shown generally at 410 and as previously described for example with respect to FIG. 4 and designed to fit with the cut-out portions 412, 414 thereof around the ankles of the foot to thereby provide comfort and custom fit of the shoe 402 to individual feet. (The bladder pump assembly 400 can also be used on the bladder of FIG. 21.) A pump assembly shown generally at 416 (and in isolation in FIG. 24) is built into this assembly 400, and unlike the pump of FIG. 5 is permanently affixed to the bladder 410. The pump assembly 416 allows the user, with his foot in the shoe 402, to incrementally increase the pressure in the bladder 410 as needed. To controllably release the pressure a relief valve assembly is provided as shown at 418.

Vertical weld lines 420, 422 on opposite sides of the relief valve assembly 418 define a small and relatively shallow compartment 424 within the bladder 410 and directly beneath the relief valve assembly. These weld lines 420, 422 also separate the bladder 410 into left and right or lateral and medial wing areas 426, 428 which communicate directly with each other and directly with the center chamber or compartment 424 through a top passageway 429. Both of the wing areas 426, 428 are divided generally into upper and lower chambers 430, 432, 434, 436 by horizontal weld line segments 438, 440, respectively, which join the inner and outer layers of the bladder together. As previously described, these weld line segments 438, 440 prevent the formation of restrictive vertical columns of air in the bladder 410. They do not, however, prevent the controllable inflation and deflation of the chambers in that air can flow between the upper and lower chambers 430, 432, 434, 436 at either ends of the weld line segments 438, 440 but through passages 442, 444, 446, 448 so narrow as to not form any significant rigid air columns when the bladder 410 is inflated.

Figure 24:
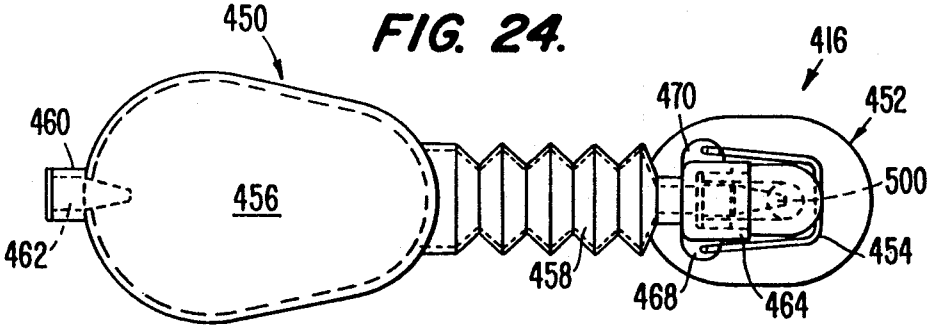
FIG. 24 is an enlarged view of the pump assembly element of the bladder pump assembly FIG. 23 shown in isolation.
Figure 25:
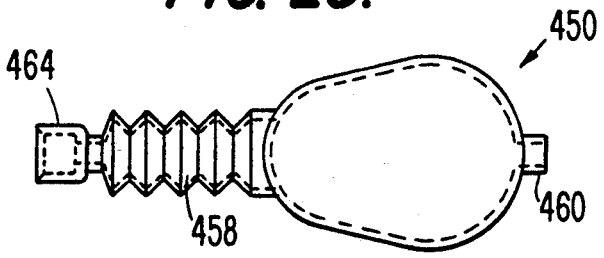
FIG. 25 is a plan view of the bulb pump of the pump assembly of FIG. 24.
Figure 26:
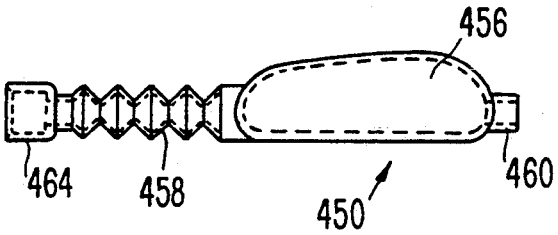
FIG. 26 is a side elevational view of the bulb pump of FIG. 25.
Figure 27:
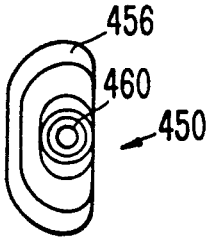
FIG. 27 is an end elevational view of the bulb pump of FIG. 25.

The pump assembly 416 is shown enlarged and in isolation in FIG. 24, and comprises three integral components—a pump as shown generally at 450, a weld flange as shown generally at 452 and a bail 454 for providing secure connection of the bulb pump to the weld flange. The pump 450, which is shown in isolation in FIGS. 25–27, is advantageously formed as a single integral unit by a blow molding procedure. In other words, the compressible bulb pump 456 and the elongated bellows connector 458 are formed together as one unit. Unlike the prior art techniques of using adhesives to connect the passageway and the compressible pump, the present integral holding connection is dependable. The connecting tubing is formed as a bellows or an accordion style connector 458, which conveniently allows the adjustment of the placement of the compressible bulb pump 456 with respect to the bladder 410 and the shoe 402 as needed for different shoes. Thus, only a single size of pump 450 needs to be molded to accommodate shoes of many sizes, from sizes six to thirteen, or eight to fourteen. Three or four different sizes of bladders 410, however, may be needed to accommodate the variations in the different sizes of shoes.

Figure 28:
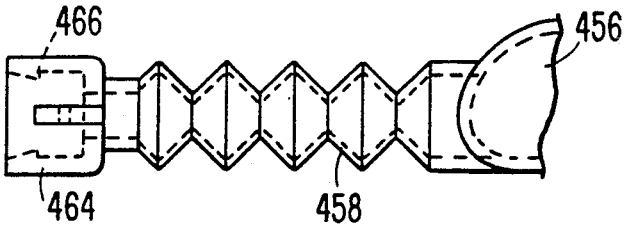
FIG. 28 is an enlarged side elevational view of the connector end of the bulb pump of FIG. 25.

An inlet sleeve 460 at the inlet end of the compressible bulb pump 456 holds a one-way inlet Vernay duckbill valve 462 (FIG. 24). One-way valve 462 allows the flow of air relative to the ambient or surrounding air only into the bulb pump 456 when the compressed bulb is released and not out of the bulb pump through the inlet sleeve 460 when the bulb pump is compressed. In other words, the valve 462, which is located at the back end of the bulb pump 456, blocks air, by closing the valve slit, from passing out the back of the bulb pump due to back pressure created when the bulb pump is depressed or squeezed. And when the bulb pump 456 is released, ambient air flows into the bulb pump through the valve 462, replenishing the bulb pump and readying the pump assembly 416 for the next pumping cycle. When the bulb pump 456 then is compressed the air therein is forced out the elongated bellows connector 458 through the end cup 464 and into the weld flange 452. The end cup 464 which is an integral part of the bellows connector 458, and hence of the bulb pump 456, is open at its end and the air flows therethrough. The inner surface of the cup 464 has optional undercuts or barbs 466 as shown in FIG. 28 and the outer surface of the cup has a pair of ears 468, 470, each having an opening 472, 474, respectively, therethrough. Both the ears 468, 470 and the barbs 466 are provided as part of the novel mechanical fit of this invention of the pump 450 to the weld flange 452.

Figure 32:
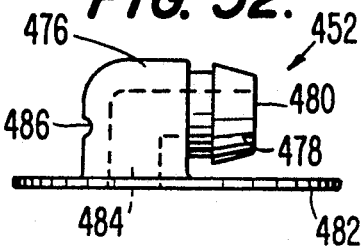
FIG. 32 is a side elevational view of the weld flange of the bladder pump assembly of FIG. 23.
Figure 33:
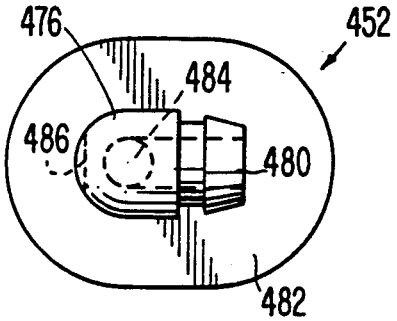
FIG. 33 is a top plan view of the weld flange of FIG. 32.

The weld flange 452 is best shown in FIGS. 32 and 33 and includes an angled pipe 476 having a male end 478 and at the male end a nib 480 having a conical outer surface. The angled pipe 476 defines a housing which is mounted and integrally formed with a radial mounting flange 482. The flange 482 and housing 476 are made of a material compatible with that of the urethane bladder 410 and can thus be and are RF welded to the bladder over the bladder opening such that the angled air passageway 484 through the weld flange 452 is directly over the opening. A horizontal groove 486 is formed on the back side of the housing 476 for the connector bail 454, as shown in FIG. 24.

Figure 29:
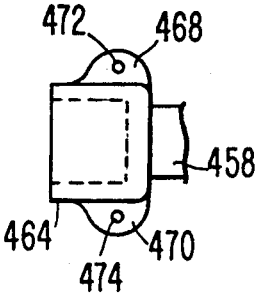
FIG. 29 is a top plan view of the end of the connector end of FIG. 28.
Figure 30:
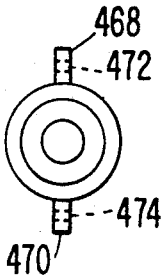
FIG. 30 is an end elevational view of the connector end of FIG. 29.
Figure 31:
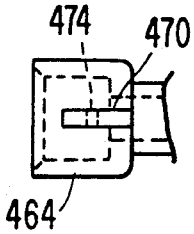
FIG. 31 is a side elevational view of the connector end of FIG. 29.
Figure 34:
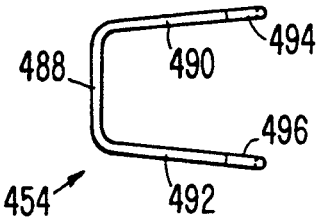
FIG. 34 is a top plan view of the bail element of the bladder pump assembly of FIG. 23, illustrated in isolation.
Figure 35:
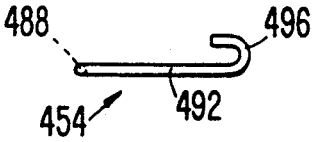
FIG. 35 is a side elevational view of the bail of FIG. 34.
Figure 36:
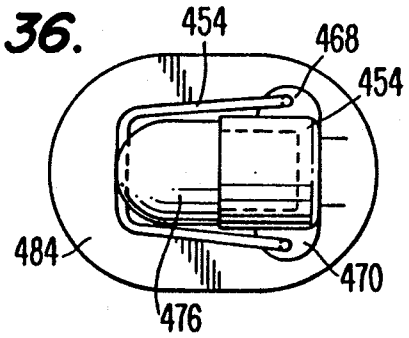
FIG. 36 is an enlarged top plan view of the pump assembly connector of the pump assembly of FIG. 24, including the bail of FIG. 34.

The connector bail 454, shown in isolation in FIGS. 34 and 35, comprises a generally U-shaped piece of wire having a base portion 488 and two leg portions 490, 492 extending out from the base portion and having hooks 494, 496, respectively, at their ends. The hooks 494, 496 hook into the corresponding openings 472, 474 of the ears 468, 470 as best shown in FIGS. 24 and 29. When the cup 464 is press fit over the male member end 478 of the weld flange 452, the nib 480 locks onto the barbs 466 in an interference engaging type of fit, resembling interlocking teeth and as can be understood from FIG. 24. The bail 454 is then snap fit into the groove 486 to provide a safety catch securement, as depicted in FIG. 36.

Similar to the Vernay duckbill valve 462 at the inlet sleeve 460 of the bulb pump 456, there is a second Vernay duckbill valve 500 in the weld flange 452 as shown by the dotted lines in FIG. 24. Thus, with the weld flange 452 RF welded in place over the opening of the bladder 410 and to the bladder and the double mechanical securement (454–486 and 480–462) securing the pump to the weld flange 452, the bladder pressurizing means is in place. The bulb pump 456 is expanded when in its natural state, and when manually compressed, air is forced through the bellows connector 458 and the weld flange 452 and into the bladder 410. When released, air is blocked from flowing into the bulb pump 456 from the bladder 410, but flows freely in through the inlet sleeve 460 into the bulb pump to reinflate it. Each compression of the bulb pump 456 incrementally inflates the bladder 410, and each one of the chambers in the bladder is thereby custom inflated to accommodate the foot in the shoe 402, with only a few squeezes or depressions of the bulb pump. If the bladder 410 is over inflated or deflation is desired as for example to adjust the fit, the pressure release valve assembly 418 is operated.

Figure 37:
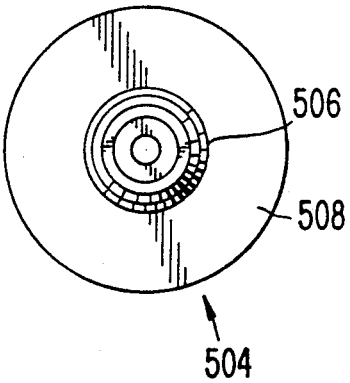
FIG. 37 is a top plan view of the housing component of the relief valve assembly of the bladder pump assembly of FIG. 23.
Figure 38:
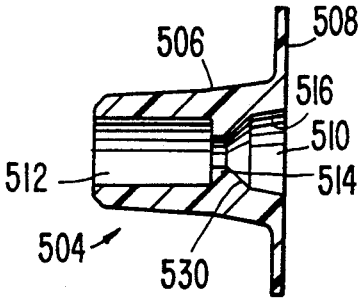
FIG. 38 is a cross-sectional view of the housing of FIG. 37.
Figure 39:
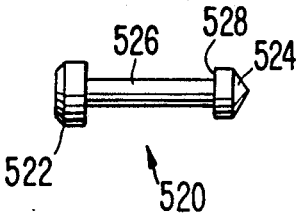
FIG. 39 is a side elevational view of the valve plunger of the relief valve assembly of FIG. 23.
Figure 40:
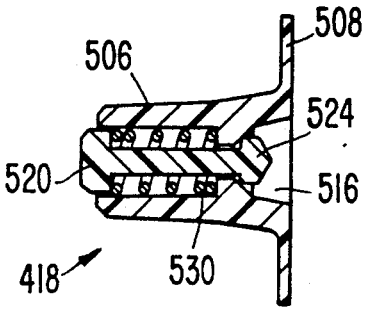
FIG. 40 is a cross-sectional view of the relief valve assembly of FIG. 22 showing the housing of FIGS. 37 and 38, the plunger of FIG. 39 and the internal helical biasing spring.

The pressure release valve assembly 418 is shown in cross-section in FIG. 40, and is similar to the press-to-deflate valves described previously herein. Consisting of only three components, its construction and operation are very easy and dependable, and no gasket or the like is needed. It can also be made very small and thus light weight, which is very important in today's athletic shoes, while still retaining the ability to accurately deflate the bladder 410 with only the touches of a fingertip. A single-piece plastic molded valve housing 504 (FIGS. 37 and 38) of the assembly 418 has a housing portion 506 and a radial flange 508 which is attached to the bladder 410. This attachment can be by RF welding, sonic welding or heat sealing. An air passageway 510 formed longitudinally through the housing portion 506 communicates with the release opening in the bladder 410. The housing portion 506 is configured to define a cylindrical spring chamber 512 within this passageway 510 near the end of the housing portion, an interior valve seat 514 at the inward end of the spring chamber 512 and forming a constriction in the passageway 510, and a plug chamber 516 at the other end of the valve seat. The plunger 520 of the assembly 418 and as shown in isolation in FIG. 39 has a plunger head 522 at one end, a plunger plug 524 at the other end and a relatively narrow plunger stem 526 extending between them. The helical compression spring 530, as shown in FIG. 40, is disposed around the stem 526 and in the spring chamber 512.

To assemble the relief valve assembly 418, the plunger plug 524 is pushed through the resilient valve seat 514 to thereby be positioned in the plug chamber 516. Since the top surface 528 of the plunger plug 420 is flat and the valve seat 514 defines a lower conical surface 530, the engagement of the plunger plug against the valve seat is advantageously only along the top outer peripheral edge of the plunger plug. This is similar to that of the arrangement shown in FIG. 7, for example. The spring 530 bears against the bottom surface of the plunger head 522, pulling the plunger plug 524 into engagement with the valve seat 514 and thereby closing off the passageway 510 and maintaining the relief valve assembly 418 in a normal closed position. The spring 530 in its natural state bears against the underneath of the plunger head 522 and pushes the plunger head up so that it is exposed beyond the top edge 532 of the valve housing portion 506. The head 522 can thereby be easily accessed by a fingertip and with only a fingertip depression the plunger head 522 and thus the plunger plug 524 are depressed downwardly, against the bias of the spring 530, and the plunger plug is pushed away from the valve seat 514. This opens the passageway 510 so that air pressure can be released from the bladder 410 through the relief valve assembly 418, which is then in a depressed open position.

Figure 41:
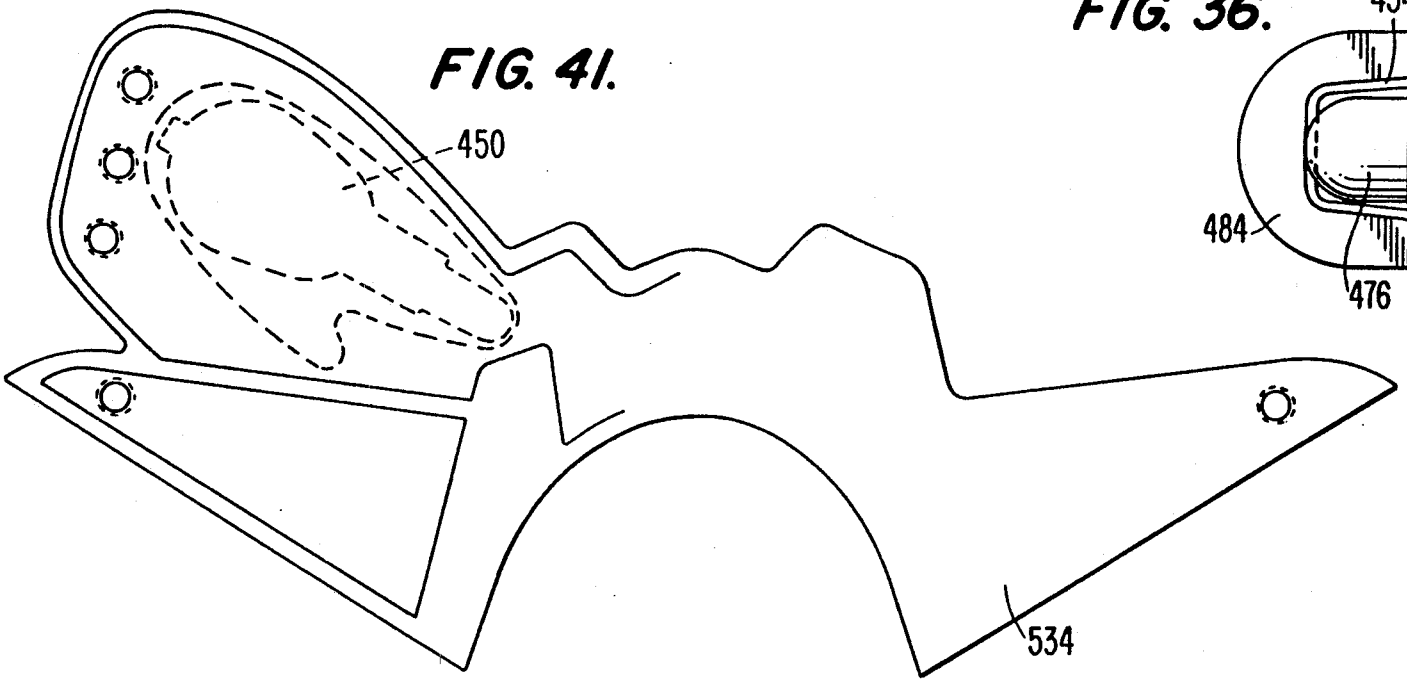
FIG. 41 is a top plan view of a shroud and pump receptacle of the present invention and is a variation of that shown on the shoe of FIG. 22.
Figure 43:
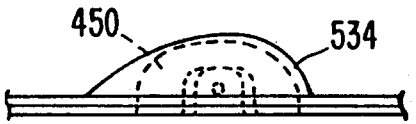
FIG. 43 is an end view of the pump portion of FIGS. 41 and 42.
Figure 42:
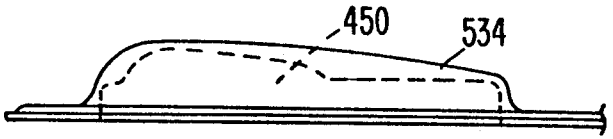
FIG. 42 is a top plan view of the pump portion of the shroud of FIG. 41.

FIGS. 41–43, while showing shroud and pump receptacle of the present invention generally at 534 which is slightly different than the shroud 403, illustrate the relative location of the pump 450 as would be found in the shoe 402 of FIG. 22. Assembly of the bladder pump assembly 400 into the shoe 402 is easy because of the design of the shoe and the bladder pump assembly. The back valve stem or head 522 is stuck out through the molded hole 536 of the shroud 534. The shroud 534 has a molded receptacle contour that goes on the outside of the upper 406 and the bulb pump 456. Once the plunger head 522 has been poked out through the hole 534 such that the relief valve assembly 418 is horizontally disposed, the entire bladder pump assembly 400 is generally lined up correctly with the bulb pump 456 on the outside side of the shoe 402. (It is also within the scope of this invention to have the relief valve assembly 418 in an angled down position such as is shown in FIGS. 1 and 16.) The bulb pump 456 is then pushed into place in the molded pump piece of the outer shroud 534 and the outer shroud stitched to the upper 406 of the shoe 402. Although a low grade adhesive may be used to tack the pump assembly into place during assembly, a high grade adhesive is not necessary since the assembly fits into the pocket defined by the shroud 534 and the shoe 502 and is held therein by the attachment of the shroud to the shoe. Due to the unique bellows connector 458 the bulb pump 456 can be manipulated both radially and angularly relative to the weld flange 452 and the bladder 410 to accommodate different size shoes, as explained previously.

Thus, the bladder pump assembly 400 is a self-contained system and does not require a detached off-board pump (148). It is small enough to be positioned on and become an integral part of the shoe 402. Manufacturing thereof is easy due to the previously-discussed press interference fit and the absence of cemented joints. The bellows connector 458, being integral with the bulb pump 456, eliminates the connecting tubes needed in the past and their probability of failure. Since the bellows connector 458 is flexible, one pump size can be used for the complete size range of shoes and some inaccuracies in the placement of the pump during shoe assembly are also thereby accommodated.

Figure 45:
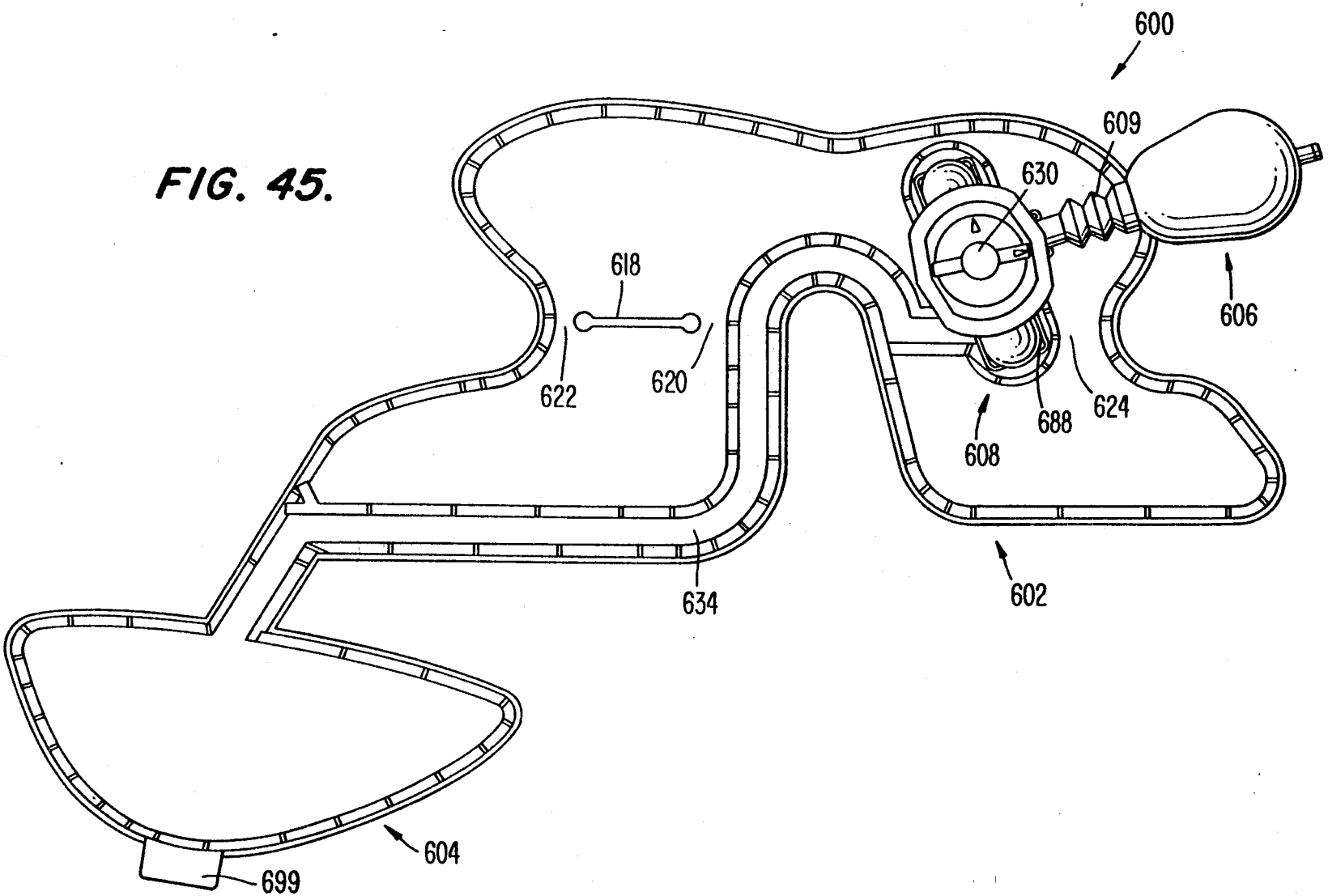
FIG. 45 is a top plan view of the bladder assembly of FIG. 44 shown in isolation and laid flat.
Figure 46:
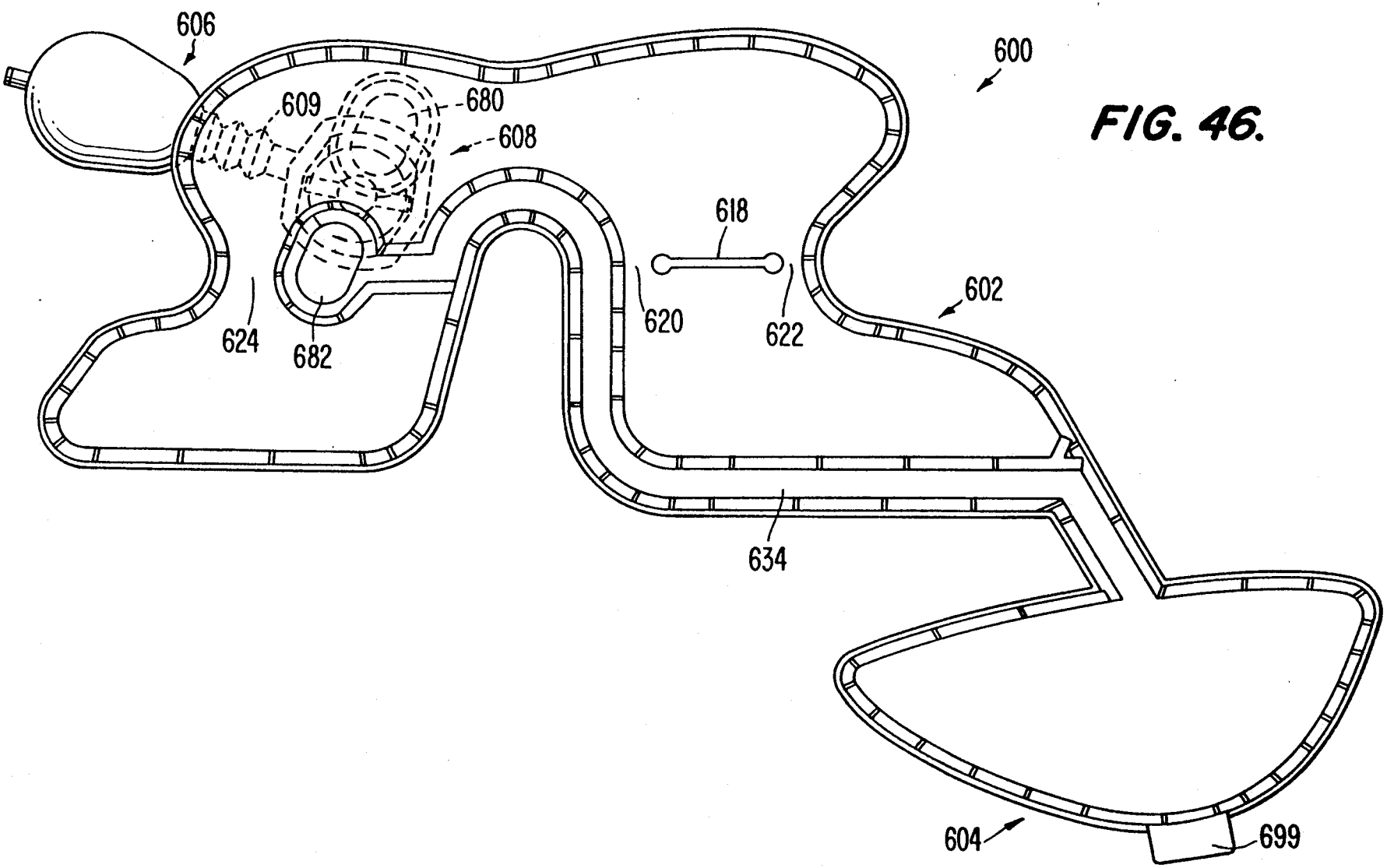
FIG. 46 is a bottom plan view of the bladder assembly of FIG. 45.

In the previously-described shoe bladder embodiments, a number of inflatable chambers are formed by the configuration of the bladder and the use of weld lines. These chambers can be inflated to different volumes to generally accommodate different feet and different fits. All of those chambers, however, are interconnected by narrow passages and are inflated from the same source and thus, when inflated, will have the same pressure, such as a three psi pressure. Although this may be adequate for some individuals and for some feet, it does not meet the ideal fit and comfort requirements of many athletes, as the different concavity areas of the foot require different pressures. In particular, the arch area, the metatarsal areas and the ankle areas often require different pressures. Proper fit of the shoe is important for all athletic activities, and all fit components of the shoe are interrelated. Accordingly, a further embodiment of the present invention provides for independent pressurization of at least two of the chambers in each shoe. This bladder assembly embodiment is shown in FIGS. 45 and 46, for example, generally at 600. It is further understood that different features of the numerous embodiments as shown and illustrated in this disclosure can be variously combined as would be within the skill in the art.

Referring to FIG. 45, the bladder assembly 600 is shown to comprise basically an ankle fit bladder, bag or chamber as shown generally at 602, an arch support bladder or chamber as shown generally at 604 physically connected to, but not in fluid or pressure communication with, the ankle bag, an on-board articulated bulb pump as shown generally at 606, and a valve mechanism as shown generally at 608. The bulb pump 606 has an articulated connector 609 similar to bellows connector 458. The bulb pump 606 is also held on the outside of the shoe 610 in and by a shroud similar to shroud and pump receptacle 534 and shaped to receive the bulb pump 606 in the upper collar portion 612 of the shoe, as can be understood from FIG. 44. The egg-shaped arch chamber 604 will preferably have one or more central weld lines (not shown) similar to weld line 354 so that it is not too large and does not have a large center peak. A central weld line provides for a gradual wedge-type shape more closely resembling and conforming to the shape of the arch of the foot. The medial weld line 618 of the ankle fit bladder 602 prevents the formation on the medial side of restrictive vertical air columns by defining only thin air communication areas 620, 622, similar to areas 166. If lateral passageway 624 proves to be too large, a lateral weld line segment (not shown) can be added. Numerous different elastomeric materials can be used for the arch and ankle bladders 602, 604. A number of factors may be considered in making this selection including the material's softness, suppleness, durability, ease of manufacture, resistance to fatigue failure, ease of attachment to the other system components, fit around the foot, and the anticipated activities of the user. Suitable materials include PVC, urethane, rubber and polyurethane, and a specific preferred material for bladders 602, 604 (or for any of the other bladders herein) is eighteen gauge, ninety-five Shore A durometer, ester-based polyurethane. Although the welds are illustrated in FIGS. 45 and 46 as small interval welds, this if for the manufacture of prototypes. For commercial embodiments they would be all one continuous weld to reduce the possibility of any leaking.

Figure 49:
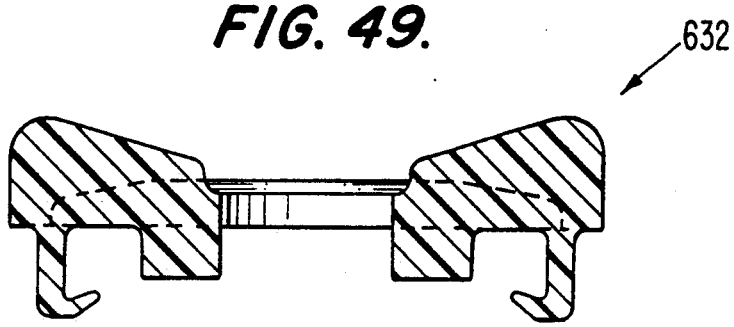
FIG. 49 is a cross-sectional view taken along line 49—49 of FIG. 48.
Figure 50:
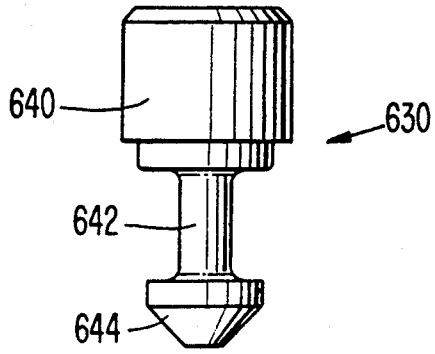
FIG. 50 is an elevational view of the plunger of the valve mechanism of FIG. 47 shown in isolation.

The valve mechanism 608 includes a centrally disposed push-to-deflate plunger 630 (FIG. 50). The top dial or button 632 (FIGS. 48 and 49) encircling the plunger 630 can be turned to any of three positions.

When in the first position, the bulb pump 606 and the deflation plunger 630 are in operative fluid communication with the ankle chamber 602. When in the second position, turned ninety degrees relative to the first, the bulb pump 606 and the deflation plunger 630 are in an operative fluid communication through an RF welded passageway 634 with the arch support chamber 604. When in the third position, between the first and second positions, the bulb pump 606 and deflation plunger 630 are not in communication with either of the bladders 602 or 604, and thus no inflation or deflation of either of them can take place. This third position is a safety feature to ensure that the bladders 602, 604 cannot be inadvertently inflated or deflated as by impact during active play. Thus, when the button 632 is rotated to its different positions, different passageways are caused to communicate with each other and the bladders 602, 604 and the inflation bulb pump 606 and the deflation plunger 630 are selectively placed into or out of communication with each other. This will become more apparent from the description below of the operation and construction of the valve mechanism 608.

Figure 44:
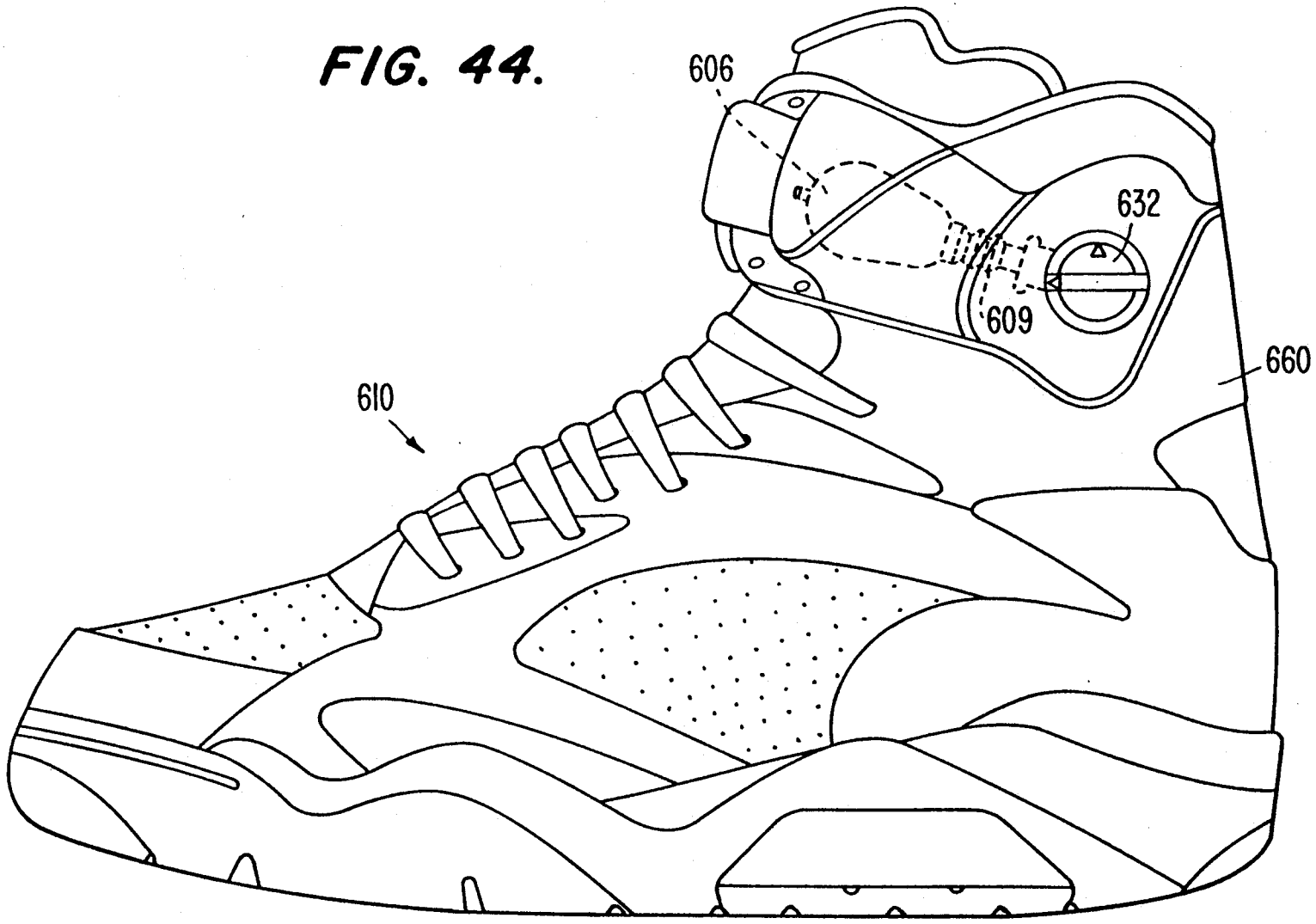
FIG. 44 is a lateral side elevational view of a shoe incorporating an alternative bladder assembly of the present invention.
Figure 47:
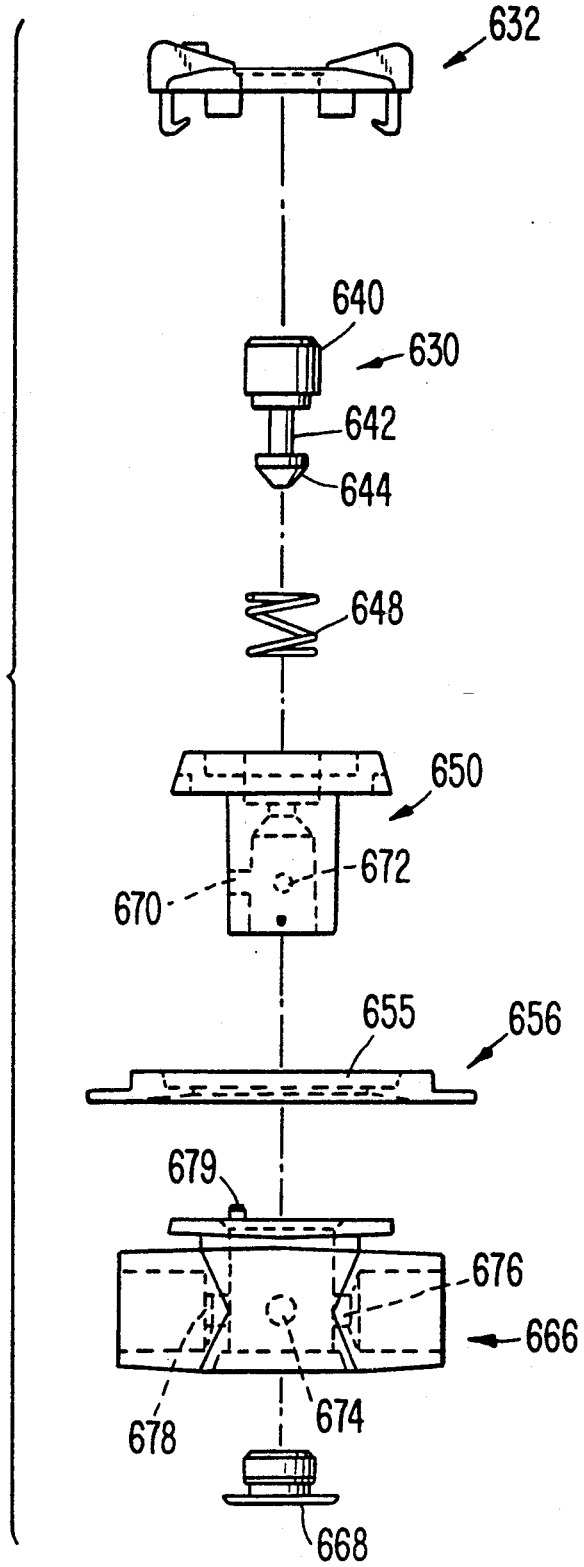
FIG. 47 is an exploded perspective view of the valve mechanism of the bladder assembly of FIG. 45.
Figure 51:
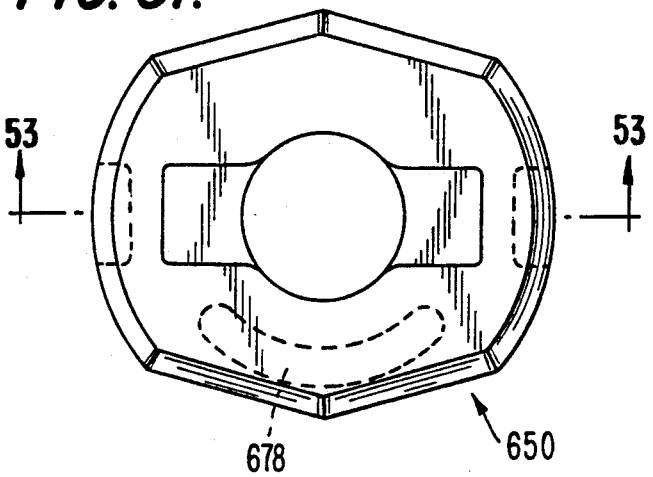
FIG. 51 is a top plan view of the barrel member of the valve mechanism of FIG. 47.
Figure 52:
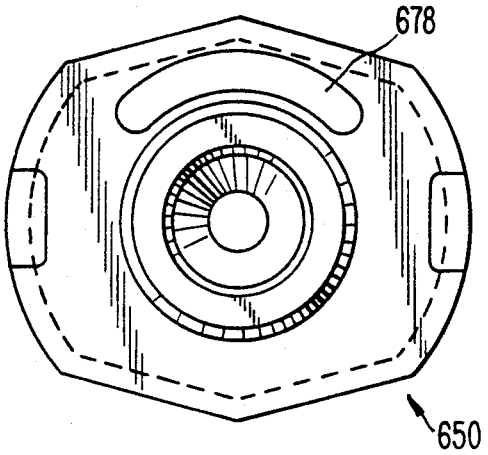
FIG. 52 is a bottom plan view of the barrel member of FIG. 51.
Figure 53:
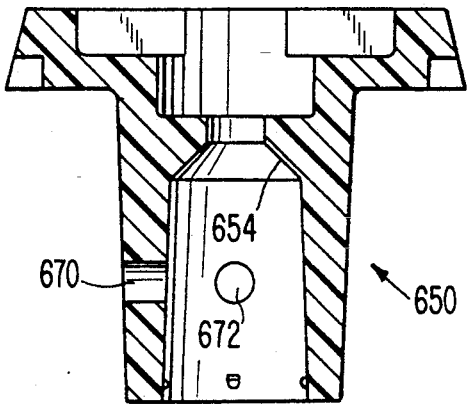
FIG. 53 is a cross-sectional view taken along line 53—53 of FIG. 51.
Figure 54:
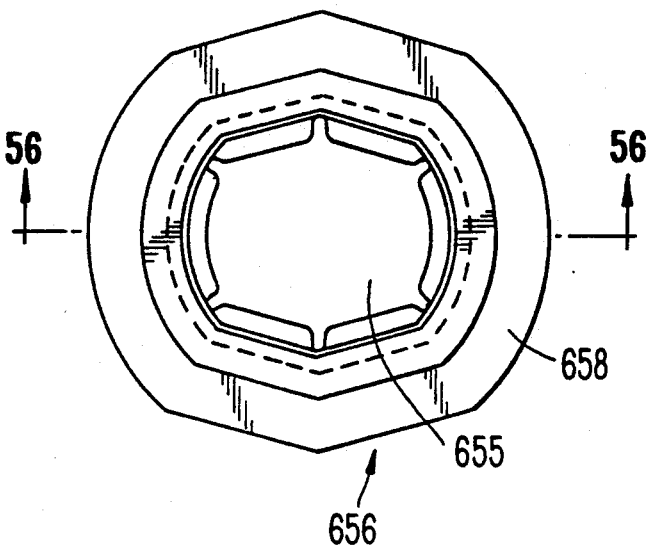
FIG. 54 is a top plan view of the snap ring of the valve mechanism of FIG. 47.
Figure 55:
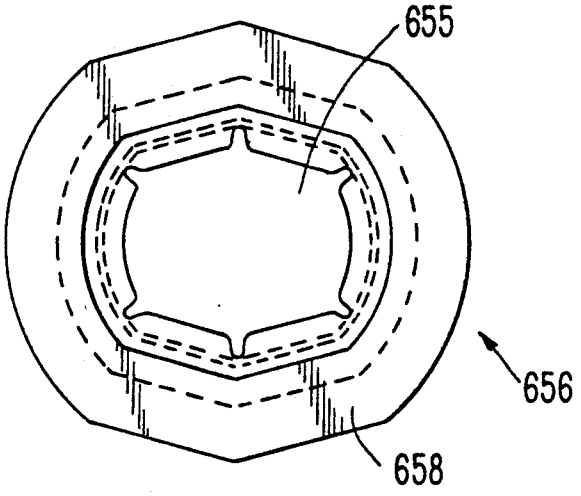
FIG. 55 is a bottom plan view of the snap ring of FIG. 54.
Figure 56:
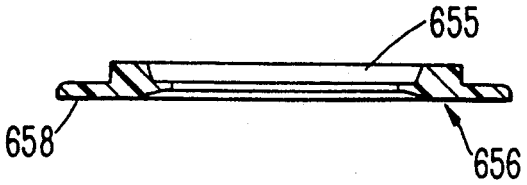
FIG. 56 is a cross-sectional view taken along line 56—56 of FIG. 54.
Figure 57:
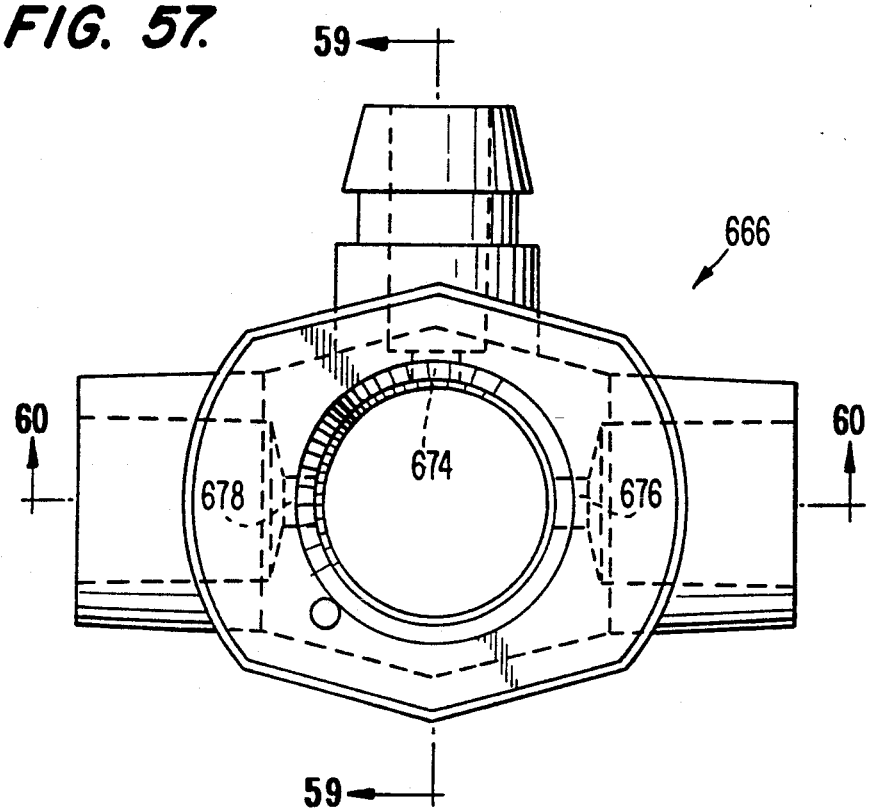
FIG. 57 is a top plan view of the tee member of the valve mechanism of FIG. 47.
Figure 58:
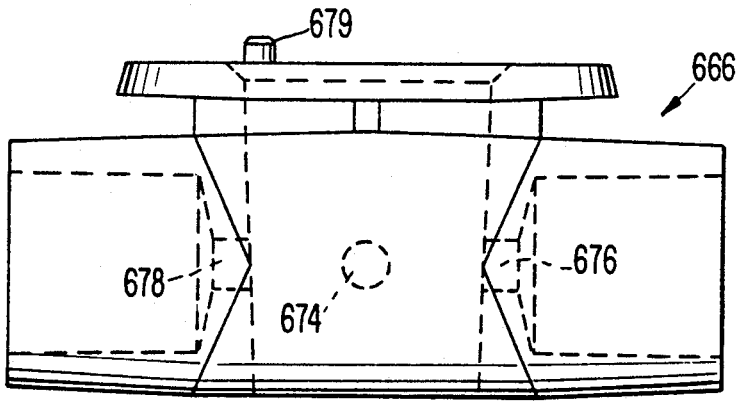
FIG. 58 is a side elevational view of the tee member of FIG. 57.

Referring to FIG. 47, the valve mechanism 608 is illustrated with its components in exploded relation for purposes of explanation. The plunger 630 (FIG. 50) has a plunger head 640, a plunger rod or stem 642, and a plunger bulb 644. The compression spring 648 is positioned around the stem 642 of the plunger 630, and the plunger-spring is inserted into the barrel 650 (FIGS. 51–53). The compression spring 648 biases the plunger 630 upwards such that the plunger bulb 644 is forced against the elastomeric valve seat 654 (FIG. 53) of the barrel 650 in a sealed closed relation. The button 632 fits snugly over the barrel 650 allowing the two parts to move or rotate together when the button is turned. The barrel 650 in turn fits through an opening 655 in the snap ring 656. The outer flange 658 of the snap ring 656 is stitched to the upper 660 of the shoe 610, as shown in FIG. 44, thereby automatically orienting the valve mechanism 608 and the bladders 602, 604 in the proper location. All components of the valve mechanism 608 below the snap ring 656 are not visible from the outside of the shoe 610 as can be understood from FIG. 44. The shoe 610 can be generally any (preferably high top) athletic shoe adapted to accommodate the present bladder assembly. An example of such a shoe 610 is Nike's AIR COMMAND FORCE shoe and as generally depicted in FIG. 44 with the present bladder assembly assembled therein.

Figure 61:
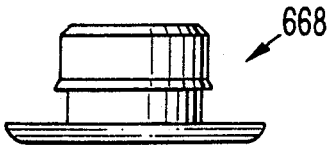
FIG. 61 is an enlarged elevational view of the plug member of the valve mechanism of FIG. 47 and shown in isolation.
Figure 59:
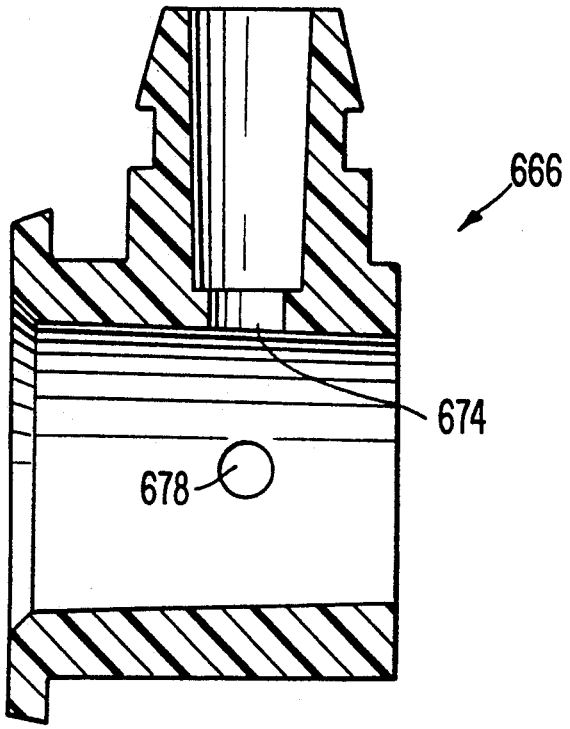
FIG. 59 is a cross-sectional view taken along line 59—59 of FIG. 57.
Figure 60:
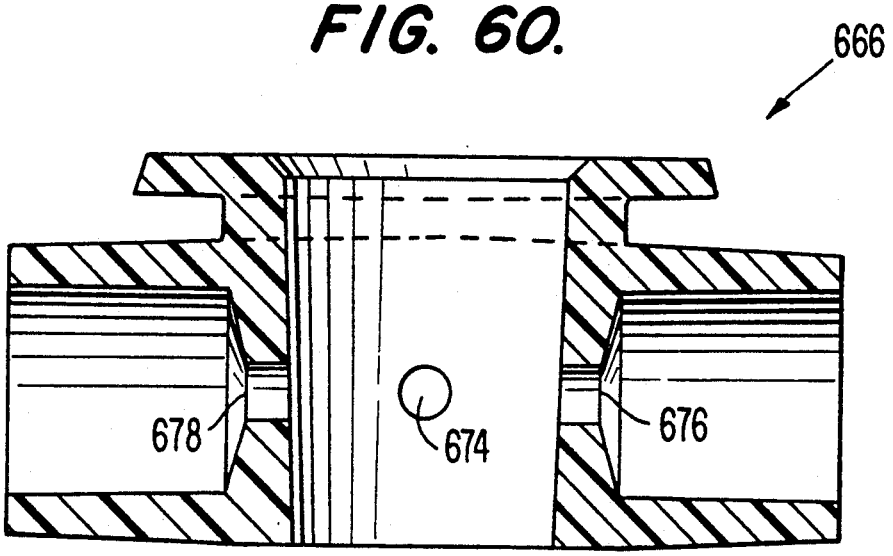
FIG. 60 is a cross-sectional view taken along line 60—60 of FIG. 57.

The snap ring 656 in turn fits over the barrel 650 and inside of the tee member 666 (FIGS. 57–60). The retainer plug 668 (FIG. 61) is fitted into the bottom of the barrel 650 through the base of the tee member 660 thereby locking the entire valve mechanism 608 together. When the button 632 is turned, the barrel 650 is caused to move which in turn realigns the openings 670, 672 (FIG. 53) of the barrel 650 with either openings 674, 676 or 678 (e.g., FIG. 60) in the tee member 666. Opening 674 leads to the articulated pump 606; opening 676 leads to the chamber 604 via channel 634; and opening 678 in turn leads to the chamber 602. Thus, aligning openings 670 and 674, and 672 and 676, which is the button first position, allows chamber 602 to be either inflated by squeezing or depressing the pump 606 or deflated by pushing plunger 630, as desired. Similarly, aligning openings 670 and 674, and 672 and 676, which is the button second position, allows chamber 604 to be either inflated or deflated. Turning the button 632 to a neutral (or the third) position therebetween prevents the accidental inflation or deflation of either chamber 602 or 604. When the button 632 is turned, the angular movement relative to the tee member 666 is defined by the movement of the arcuate slot 678 (FIG. 52) of the barrel 650 on the nib 679 (FIG. 58) on top of the tee member. Separate polyurethane elastomer weld flanges 680, 682 communicate the tee member 666 with the respective bladders 602, 604. The first communicates directly with the ankle bladder 602, and the second communicates via the passageway 634 with the arch bladder 604. These flanges 680, 682 can be similar to weld flange 452 shown in FIGS. 32 and 33.

It is also within the scope of the present invention to provide for the independent and separate inflation and deflation of more than two bladder chambers within shoe 610. The extra bladder chamber for example might be in the metatarsal area, in the tongue, provide a cushioning layer in the midsole, provide a full sockliner under the foot, a midsole, forefoot or heel chamber, a medial post for pronation control, a lateral crash pad, a cushion directly under the heel, or a cushion under the arch and forefoot. The tee member 666 would be accordingly reconfigured to include more than three passageways to separately and selectively inflate this additional air chamber(s). In lieu of the tee member 666 a manifold having different outlets can be used. Preferred materials for the valve components are nylon 6/6 for the button 632, fifty percent glass-filled nylon (Verton) for the plunger 630, "302" stainless steel with a spring rate of twenty pounds per inch for the compression spring 648, polyurethane elastomer for the barrel 650, polyester elastomer (Shore 60D Hytrel or Riteflex) for the snap ring 656, acetal for the tee member 666 and twenty percent glass-filed acetal for the plug 668.

A preferred assembly sequence of the valve mechanism 608 will now be described. First, both of the weld flanges 680, 682 are welded to the bladder. The snap ring 656 is stitched by its outer flange 658 in place to the inside of the shoe upper 660. The compression spring 648 is placed over the plunger 630 and then the spring and plunger are pressed into the barrel 650. The barrel 650 is pressed into the tee member 666 from the top thereof, the plug 668 is pressed into the barrel-tee assembly from the bottom thereof, and the assembly is then snapped onto the two weld flanges 682, 684 on the bladder. The wire bail 688 (FIGS. 62 and 63) is hooked at its ends 690, 692 into the holes 696, 698 on the pump 606 as shown in FIG. 64, similar to the connection of bail 454. A Vernay duckbill valve is attached to the tee member 666 at the opening 674, and the pump 606 is attached to the tee member 666 at the opening over the duckbill valve. The bail 688 is snapped back over the valve mechanism 686 and into the channels on the weld flanges 680, 682, similar to channel 486. The entire assembly is placed in the shoe 610 and pushed through the snap ring 656, and the button 632 is snapped onto the top of the barrel 650. The snap ring 656 thereby automatically locates the bladder assembly properly in the shoe 610. Since the hole in the shoe upper 660 has a rectangular (hexagonal or the like) type of shape, as opposed to a circular shape, the bladder assembly is also correctly oriented in the shoe 610. The tab 699 attached to the arch chamber 604 can be optionally used to stitch the bladder assembly to the inner sole of the shoe 610. Assembly of the present bladder assembly is thus easy and generally foolproof.

Thus, when the button 632 is rotated, the barrel 650 and the plug 668 turn with it and a slight rotation of the plunger and the spring results. The snap ring 656 and the tee member 666 are fixed though and do not rotate with the button 632. A liner (similar to liner 380) is positioned and secured inside of the shoe 610 between the foot and the bladders 602, 604 to prevent foot skin or sock from contacting them. The liner can comprise a brushed nylon fabric with a foam backing, and the foam can be a polyurethane, latex or rubber material. All fittings other than the weldings and the stitchings are advantageously friction fit connections, and no adhesives are needed.

Figure 62:
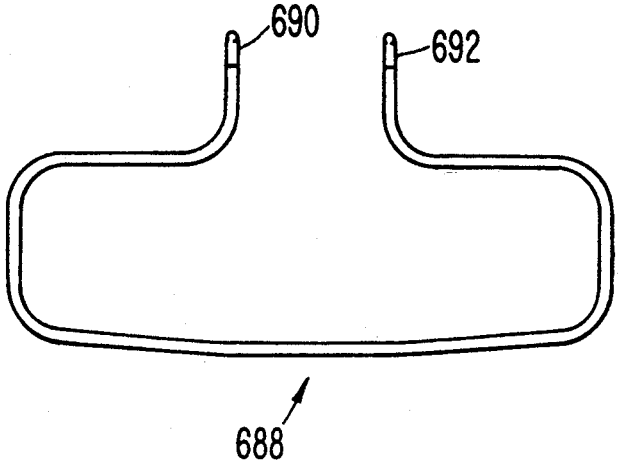
FIG. 62 is a top plan view of the bail of the bladder assembly of FIG. 45 and also shown in isolation.
Figure 63:
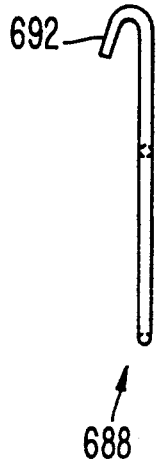
FIG. 63 is a side elevational view of the bail of FIG. 62.
Figure 64:
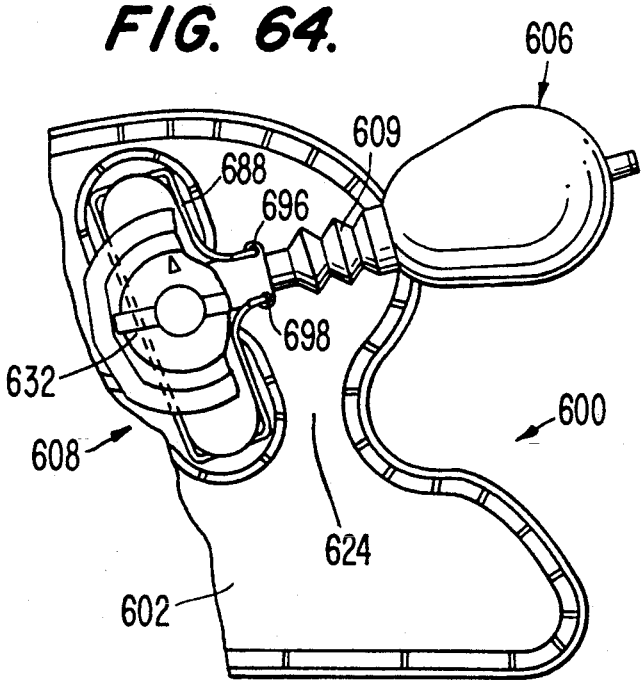
FIG. 64 is a top plan view of the valve mechanism portion of the bladder assembly of FIG. 45 with portions thereof broken away to illustrate the connection of the bail of FIGS. 62 and 63.

The bail 688 as illustrated in FIGS. 62 and 63 may be difficult to manufacture and to assemble on the pump assembly. As can be seen in the drawings, bail 688 has a number of bend angles which must be precisely formed. The production workers, to assemble the pump assembly, must snap the bail 688 into place which can be a difficult procedure. Additionally, if under extreme conditions the foot is pushed against the shoe, the bail 688 might tend to pop out or bend and then air could leak out of the bladder system. In other words, if the tee member 666 were violently pushed straight out from the back side, the flanges 682, 684 could bend outwardly, thereby causing an air leak. Accordingly, an improved configuration of the bail is provided for and shown in FIGS. 65 and 66 generally at 720 as a component of an alternative bladder system of the present invention shown generally at 722. This system can be used in an athletic shoe such as Nike's AIR COMMAND FORCE.

Figure 65:
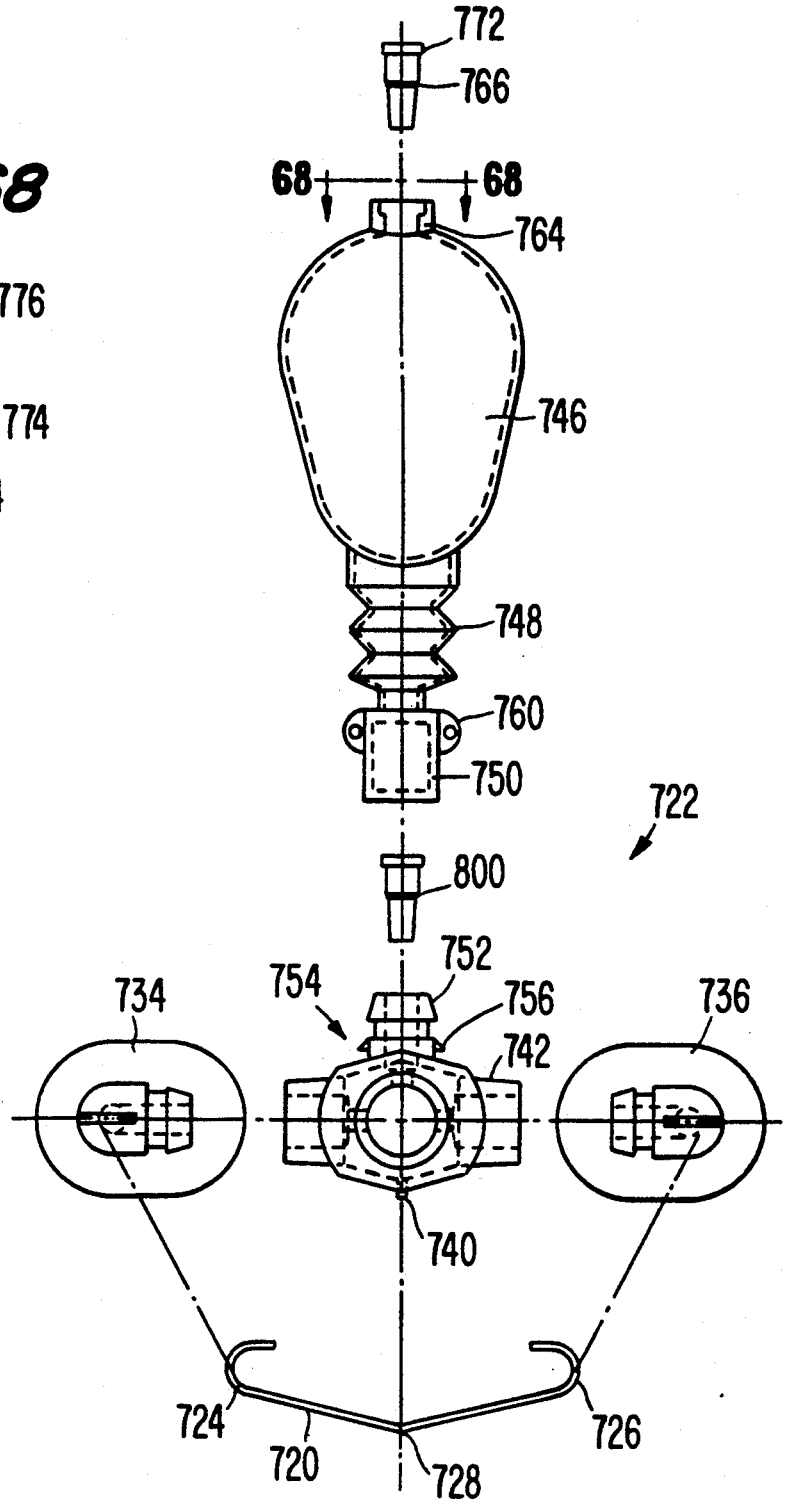
FIG. 65 is a top plan view of an alternative bladder system of the present invention with the components thereof illustrated in exploded relation.
Figure 66:
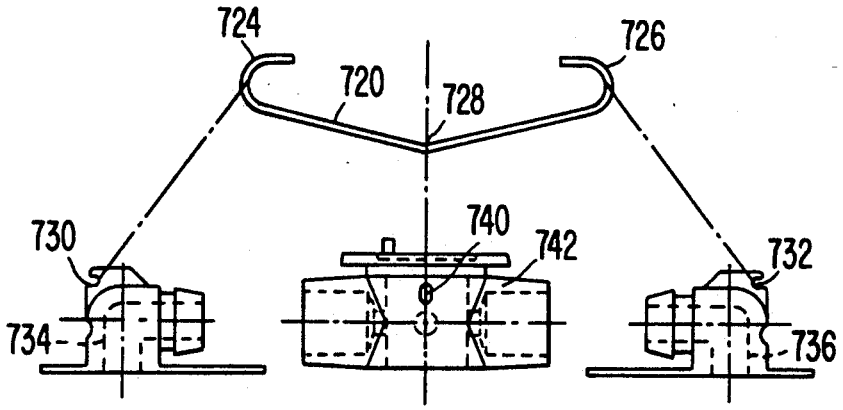
FIG. 66 is an end elevational view of the end components of the system of FIG. 65 illustrated in exploded relation.

Referring to FIGS. 65 and 66, it is seen that the bail 720 simply comprises a strand of wire, preferably music wire, bent around at each end to form hooks 724, 726 and having a wide or slight V-shaped bend 728 in the center thereof. These hooks 724, 726 are hooked around the grooves or catches 730, 732, respectively, formed at the tops of the opposing weld flanges 734, 736, as best shown in FIG. 66. The V-shaped bend 728 fits into the upwardly-facing hook formed on the back side of the manifold or acetal tee member 742. This hook 740, while depicted in FIGS. 65 and 66, is perhaps best shown in FIG. 67. The bail 720 thereby acts as a tension spring holding the opposing weld flanges 734, 736 firmly to opposite sides of the tee member 742. The bail 720 is thus much smaller and simpler in design than the large, square shaped bail 688.

Figure 67:
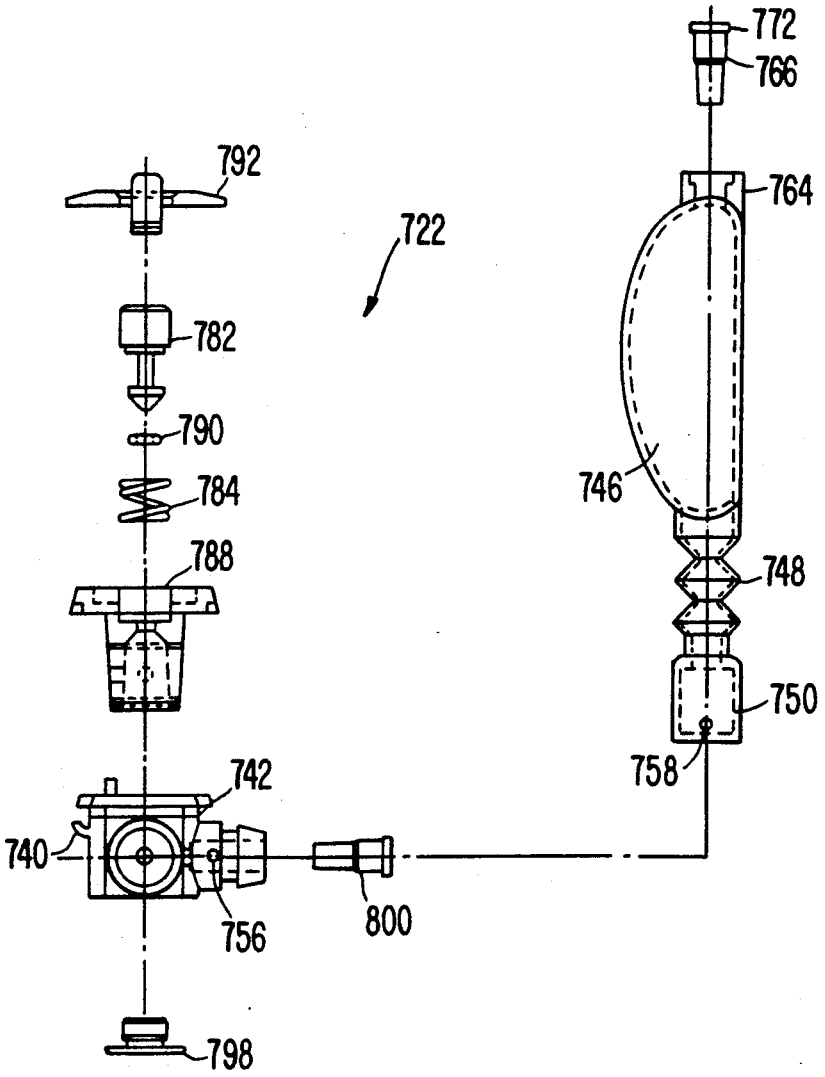
FIG. 67 is a side elevational view of the system of FIG. 65 wherein the components are also illustrated in exploded relation.
Figure 69:
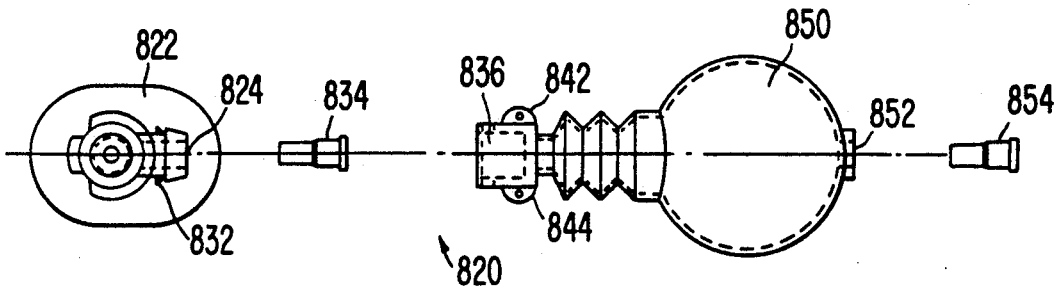
FIG. 69 is a top plan view of another alternative bladder system of the present invention wherein the components are illustrated in exploded relation.
Figure 70:
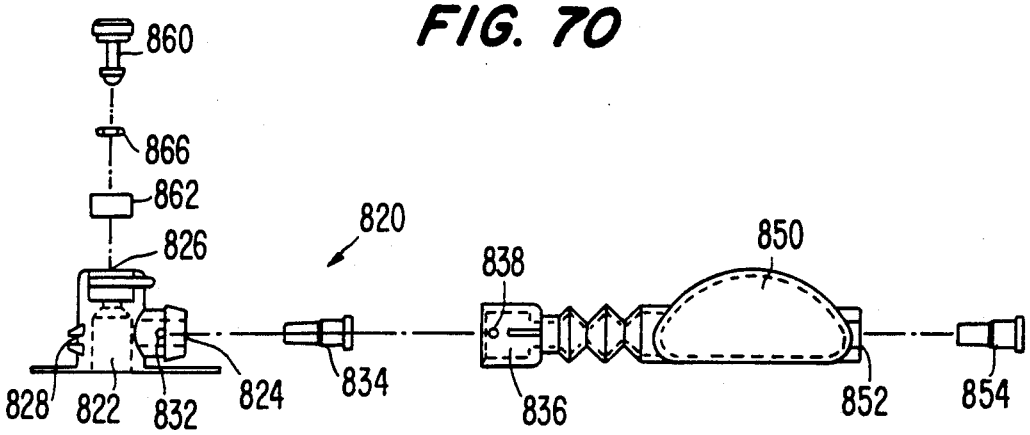
FIG. 70 is a side elevational view of the system of FIG. 69 wherein the components are also illustrated in exploded relation.
Figure 71:
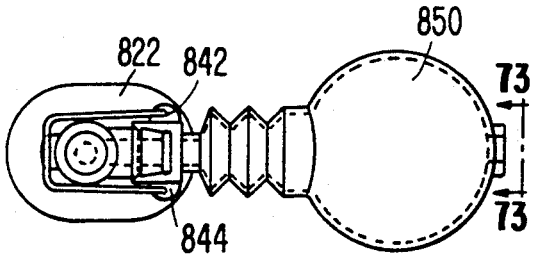
FIG. 71 is a top plan view of the system of FIG. 69 wherein the components are illustrated assembled together.

The bulb pump 746, articulated bellows connector 748 integrally formed therewith, and connector flange or cup 750 of the system of FIG. 65 are similar to those illustrated in FIG. 45, for example, and the differences are discussed below. To secure the cup 750 to the inlet pipe end 752 of the tee member 742, a mechanical (friction) interface 754 is provided. This interface 754 preferably comprises a pair of barbs 756, triangular-shaped members as shown for example in FIG. 65 formed at the base of the inlet pipe 752, and a pair of corresponding holes or barb receptacles 758 formed in the cup as shown in FIG. 67, for example. Although the placement of the barbs and barb receptacles can be reversed, that arrangement would likely be more difficult to manufacture. The cup 750 is force fit onto the inlet pipe 752 such that the barbs 756 snap into and lock into the receptacle openings 758.

Unlike bail 688, bail 720 does not directly hold the cup 750 or the pump 746 to the tee member 742. The ears 760 projecting out from the cup 750, though in this embodiment not having the bail ends hooked into them, still have a function with the system of FIG. 65; they serve a locating function during the punching of the barb receptacles 758. The ears 760 fit flat into the jig or the punching equipment (not shown) and ensure that the cup 750 is lined up, located and firmly held so that the holes are punched in the proper locations.

The bulb pump 746, which is preferably made of Riteflex polyester or Elvax-EVA, has an improved configuration. The loft, or height of the bulb pump 746 when it is laying on a flat surface and as can be understood from FIG. 67, is approximately seven and half millimeters, which is greater than that of the previously-discussed bulb pumps. It thus concentrates the air volume in the middle pushing area of the pump 746. In other words, it is higher in the area where the thumb pushing takes place, thereby increasing the air flow volume with each push. By making the bulb pump 746 taller, a greater volume increase is effected—more air is moved with each pump push—without increasing the width and length dimensions of the pump. The pump 746 holds approximately eight cubic centimeters of air, as contrasted with the pump of FIG. 46 which has a lesser volume of approximately seven cubic centimeters. The entire bladder system 722, which of course includes a bladder such as bladders 602 and 604, can thus be inflated with only fifteen to twenty pumps or depressions of the bulb pump 746. In contrast, a known competing pump shoe requires on the order of thirty-five to fifty pumps—a laborious and time consuming fitting process. (The large hand-held pump 200 of FIG. 5 requires approximately three or six squeezes.) The collar bag or chamber 602 pumped by the pump 746 has a maximum volume of fifty-two cubic centimeters, and the smaller arch chamber 604 has a maximum volume of only twenty-five cubic centimeters. As shown in FIG. 45 a side channel 634 integrally formed along an edge of the collar bag 602 communicates the pump 746 with the arch chamber 604. Provision for independent pressurization of the ankle and arch collar chambers is advantageous because of the wide variation among individuals in their fit requirements and comfort preferences in these areas.

Figure 68:
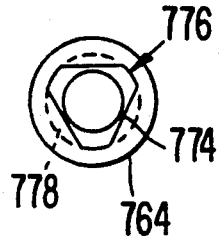
FIG. 68 is an enlarged view taken on line 68—68 of FIG. 65.

The bulb pump 746 has an air inlet or stub end 764 in through which air passes to re-inflate the bulb after it has been compressed and released. A check valve 766 is held in this inlet to prevent the air from escaping out through it when the bulb pump 746 is depressed and forcing air into the air bag through the connector. A novel mounting of this valve in the distal end of the bulb pump is provided as best illustrated in FIG. 68 generally at 770. Mounting 770 allows the inlet silicone Vernay duckbill (check) valve 766 to be flush or slightly recess mounted. The top lip or head 772 thereof thus does not extend out such that it can be caught on anything either during assembly thereof or during use, and thereby be pulled loose during rough handling. This mounting 770 also locks the valve 766 in place and prevents it from popping out in the event of violent pumping action. In fact, the valve is held so securely that to remove it essentially requires that it be yanked out with needle nose pliers.

Referring to FIG.(s) 68 (and 73), the snap-in locking arrangement 770 for the valve 766 is illustrated. The open area is shown by the circle 774, and the triangle which is flush with the top of the inlet end and is formed integrally with the bulb pump 746 and defined by a plurality of pads or tabs 778 molded into the opening, which cover the top of the valve. When the valve 766 is pushed into the stub end 764, the tabs 778 are forced down and when the valve has been pushed in place, the tabs snap up flush with the top surface. These tabs 778 secure and lock the valve in place, such that no portion thereof extends beyond the stub end 764. They thereby ensure that the valve 766 does not fall out due to any extreme back pressure from the pump.

Figure 48:
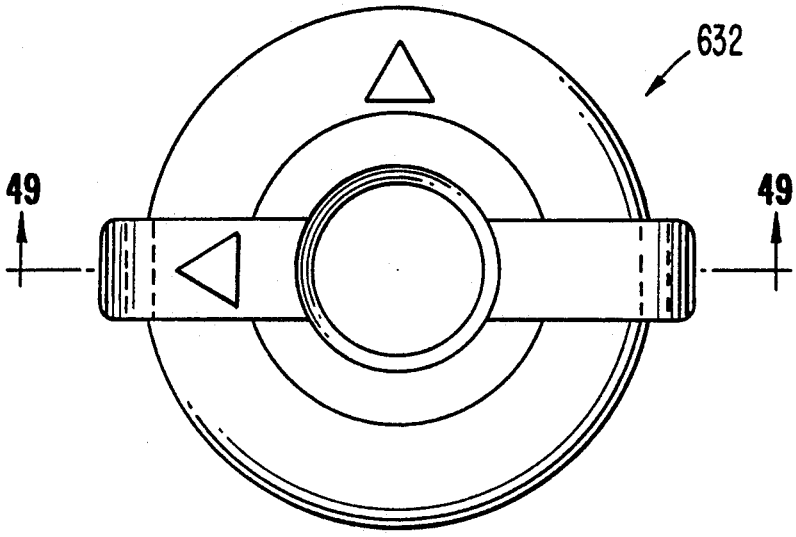
FIG. 48 is a top plan view of the button of the valve mechanism of FIG. 47.

To controllably deflate the bladder, a fifty percent glass-filled nylon plunger 782, as shown in FIG. 67, is pushed down against the bias of a "302" stainless steel compression spring 784 to thereby communicate the desired chamber with the deflation outlet opening 788. An O-ring 790 can optionally be provided to ensure that there is no leakage out around the plunger 782. The nylon 6/6 button 792 is the same as button 632, as shown in FIGS. 48 and 49, and when turned allows the bulb pump 746 and the deflation plunger 782 to communicate with the first chamber (604), the second chamber (602) or neither. When in this third position, it is in a safety position to prevent the accidental inflation or deflation of either of the chambers as may occur during active contact play.

The assembly of the bladder system is thus relatively simple. The two opposing weld flanges 734, 736 are located and R.F. welded to the collar bag, such as the bag 602 as shown in FIG. 45. The spring 784, plunger 782 and O-ring 790 are assembled together, and this assembled unit is then itself assembled into the urethane barrel 796. The barrel assembly is inserted into the inner diameter of the tee member 742 from the top, with the arrow on top of the barrel 796 pointing towards the barbed extension 756 on the tee member 742. The acetal plug 798 is then inserted into the barrel/tee assembly, into the inner diameter of the barrel 796 until the barbed detail on the plug engages the ring detail on the inner diameter of the barrel, thereby holding the assembly together. The silicone Vernay duckbill valve 800 is inserted into the inner diameter of the barbed extension on the tee member 742. The other valve 766 is inserted into the pump intake, and snap locked in place by the mounting 770 as described above. The pump assembly is then assembled into the tee member 742, and the pump 746 is pushed onto the tee member until the barbs 756 on the tee member engage the holes 758 on the pump. This entire unit is then attached to the two opposing weld flanges 734, 736 on the bag assembly with the barbed extension on the weld flange inserted into the inner diameter of the two opposing round extensions on the tee member. The bail 720 is then attached by its hooks to the rooster tail detail or hooks 730, 732 on the weld flanges 734, 736 and the bail, in turn, rests on the hook 740 on the tee member 742. The bail 720 thereby acts as a tension spring holding the weld flanges 734, 736 and tee connections 742 together, but still allowing some flexible movement. The completed collar bag assembly is then inserted into the upper of the shoe and the valving mechanism is snapped through a snap ring (656) which is sewn onto the upper on the lateral side thereof. The bag assembly is thereby located and held in place in the shoe.

The system disclosed in FIGS. 65–68 is preferably for a large shoe, an adult shoe, for example, wherein independent inflation and deflation or pressurization of the arch and collar chambers 602, 604 is desired. A bladder system for a smaller or child's shoe wherein an arch chamber (604) is not provided (or independent pressurization of the arch and collar chambers is not needed) is shown in FIGS. 69–73 generally at 820. Examples of currently available children's shoes in which this system can be used are Nike's AIR ULTRA FORCE and the KID ULTRA FORCE as advertised in Nike's Spring 1991 catalog. This system 820 does not require an operable button or the two stem or weld flange assemblies of the system 722 since selectively independent pressurization of two chambers is not provided.

The system 820 does include a polyurethane weld flange or valve stem 822 having an inlet opening 824 and an outlet opening 826 orthogonally positioned relative to one another. A groove 828 is formed by projecting lips on the back side of the valve stem 822 opposite to the inlet opening 824. The inlet opening or port 824 has a pair of barbs 832 similar to the barbs 756. With a Vernay duckbill valve 834 in the inlet port, the cup 836 is snap-fit onto the inlet port 824 and the barbs 832 lock into the corresponding holes 838 in the cup. The square-shaped bail or wire retainer 840 (FIGS. 71 and 72), which hooks at its opposite ends into the openings 842 in the ears 844 of the cup and then is held in its base portion in the groove 828, assists in the securing of the cup 836 to the inlet port 824. In other words, the barb and the bail provide double securement.

Figure 73:
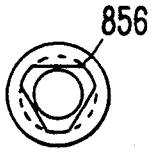
FIG. 73 is an enlarged view taken on line 73—73 of FIG. 71.
Figure 72:
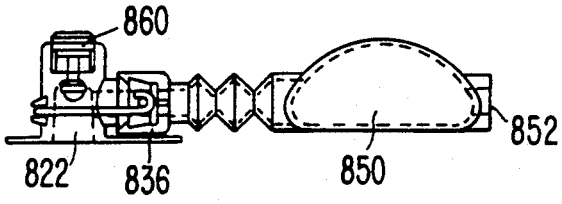
FIG. 72 is a side elevational view of the system of FIG. 71.

The bulb pump 850 which is formed of Elvax "470-EVA" has a rounder configuration than the bulb pump 746, but it still has the improved raised loft and holds approximately four cubic centimeters of air. The air inlet 852 to the pump 850 has a Vernay duckbill valve 854 positioned therein and held by the valve retainer 856 as shown in FIG. 73 and similar to that described for FIG. 68.

The bladder or bag 858 (or e.g., 134), which preferably has a volume of forty-seven cubic centimeters, can be deflated by finger depressing the fifty percent glass-reinforced nylon plunger 860 against the bias of the "302" stainless steel compression spring 862 positioned in the outlet port 826 of the valve stem 822. An optional O-ring 866 can be provided to prevent any possibility of leakage of air out around the plunger 860.

Figure 74:
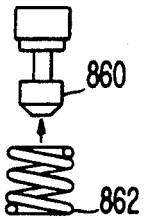
FIG. 74 is an elevational view illustrating an assembly step of the system of FIG. 69.
Figure 75:
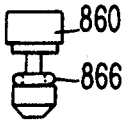
FIG. 75 is an elevational view illustrating another assembly step.
Figure 76:
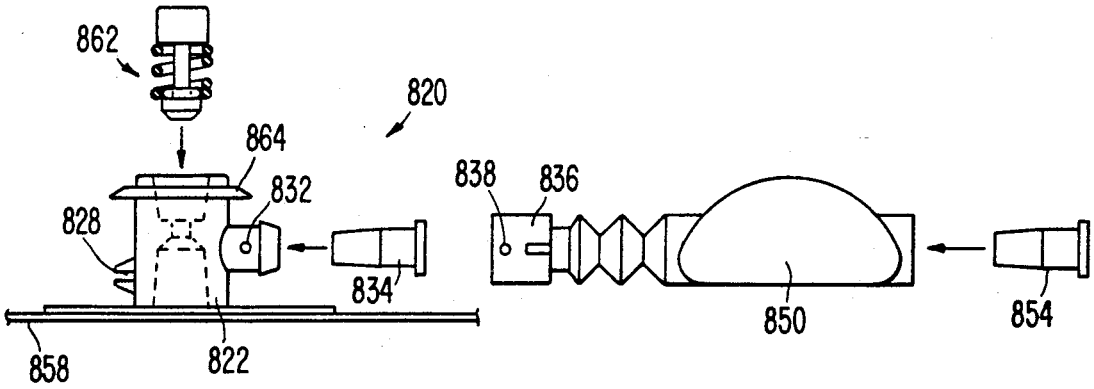
FIG. 76 is an elevational view illustrating a further assembly step.
Figure 77:
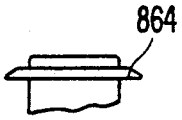
FIG. 77 is an elevational view illustrating an assembly step.

Referring to FIGS. 74–77, the steps for assembling the system are illustrated. As shown in FIG. 74, the compression spring 862 is assembled on the plunger 860. If an O-ring 860 is to be used, it is assembled on the plunger 860 as illustrated in FIG. 75 prior to assembling the spring 862 on the plunger. The assembled plunger-spring (or plunger-O-ring-spring) 862 is assembled into the valve stem 822, as shown in FIG. 76. The Vernay valve 834 is inserted into the inner diameter of the barbed extension on the valve stem 822 and the second Vernay valve 854 is inserted into the back or intake end of the pump. The pump 850 is then assembled onto the barbed extension on the valve stem 822 until the barbs 832 engage the holes 838 on the pump. The collar bag assembly is then inserted into the upper of the shoe with only the plunger 860 showing through to the outside of the shoe on the lateral side thereof. The flange 864 on the top is used as a bonding surface with the inside of the upper to locate the bag assembly and help hold it in place. The flange or collar 864 is shaped as a thin oval-shaped piece that makes a neat and clean appearance on the outside of the shoe upper in addition to locking the system to the shoe.

The bladder systems of the present invention with their onboard pumps can be quickly and reliably assembled into athletic shoes. The components are held together with reliable mechanical fits. These fits, while allowing for flexible movement of the components, prevent air leaks resulting from rough use thereby providing for reliable dependable performance. The bladders by their construction and arrangement provide an individual fit of the athletic shoe to the users foot while not reducing dorsi and plantar flexion of the foot. Athletic performance is enhanced. Little or no air is provided behind the Achilles to prevent the foot from being pushed forward in the shoe which can cause blistering of the toes and misalignment of the foot in relation to other cushioning or stability features that may be incorporated into the shoe. Independent pressurization, according to some embodiments of this invention, of different bladder chambers, such as ankle and arch chambers, can be made.

Numerous characteristics and advantages of the invention have been described in detail in the foregoing description with reference to the accompanying drawings. However, the disclosure is illustrative only and the invention is not limited to the precise illustrated embodiment. Various changes and modifications may be affected therein by persons skilled in the art without departing from the scope or spirit of the invention. For example, the bladder could be used in a three-quarter height shoe wherein the ankle portion of the upper extends only partially over, or only slightly above, the medial and lateral malleoli. As another example, the arch bladder singly or in combination with a metatarsal bladder could be incorporated into a low top such as a running or tennis shoe.

What is claimed is:

1. A shoe bladder system, comprising:

an inflatable shoe bladder having a pair of opposing major surfaces formed of flexible material;

a hollow fluid inlet stem assembly secured on and extending away from said flexible material forming one of said major surfaces of said shoe bladder, said inlet stem assembly having a fluid inlet opening and a fluid outlet opening in fluid communication with said shoe bladder;

pump means for inflating said shoe bladder, said pump means including a bulb pump having a fluid inlet and a fluid outlet in fluid communication with said fluid inlet opening of said inlet stem assembly; and spring means for securing said bulb pump to said stem assembly, said spring means including a thin wire member, one portion of said thin wire member being connected to said bulb pump on one side of said inlet stem assembly and another portion of said thin wire member being in contact with an opposite side of said inlet stem assembly.

2. The system of claim 1 wherein said inlet and outlet openings of said fluid inlet assembly are orthogonally positioned relative to one another, said bulb pump includes a pair of ears, and said thin wire member has a opposite ends with each of said ends being connected to one of said ears.

3. The system of claim 1 wherein said inlet opening to said inlet stem assembly includes a tubular extension from the side of said assembly, at least one projection extending from an exterior surface of said tubular extension, and at least one corresponding hole formed in the fluid outlet of said bulb pump for receiving said at least one projection in locking engagement.

4. A shoe bladder system, comprising:

a shoe bladder assembly including first and second inflatable bladder chambers, each of said chambers having a pair of opposing major surfaces formed of flexible material;

a first stem member secured to said shoe bladder assembly and in fluid communication with said first bladder chamber;

a second stem member secured to said shoe bladder assembly and in fluid communication with said second bladder chamber;

said first and second stem members being secured to said flexible material forming one of the major surfaces of one of said chambers and extending outwardly therefrom;

a bulb pump having a fluid inlet and a fluid outlet;

connector means for connecting in fluid communication said bulb pump with said first and second stem members, said connector means including a fluid inlet stem assembly having a fluid inlet opening in fluid communication with said fluid outlet of said bulb pump and fluid outlet openings in fluid communication with said first and second stem members, said inlet stem assembly being secured to said shoe bladder assembly at a location between said first and second stem members; and securing means for securing said first and second stem members to said inlet stem assembly, said securing means including a thin wire member having a first end connected to said first stem member and a second end connected to said second stem member and applying a tension spring force to firmly hold said first and second stem members against said inlet stem assembly while allowing flexible movement of said first and second inflatable bladder chambers.

5. The system of claim 4 wherein said first and second ends of said thin wire member are hooked shaped and are held within hook receiving grooves in respective ones of said first and second stem members.

6. The system of claim 4 wherein said inlet opening to said inlet stem assembly includes a tubular extension from a side of said assembly, at least one projection extending from an exterior surface of said tubular extension, and at least one corresponding hole formed in the fluid outlet of said bulb pump for receiving said at least one projection in locking engagement.

* * * * *